US012018847B2

(12) United States Patent
Na et al.

(10) Patent No.: US 12,018,847 B2
(45) Date of Patent: Jun. 25, 2024

(54) AIR CONDITIONER

(71) Applicant: SAMSUNG ELECTRONICS CO., LTD., Suwon-si (KR)

(72) Inventors: Seon Uk Na, Suwon-si (KR); Jin-Gyun Kim, Suwon-si (KR); Jong Kweon Ha, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 377 days.

(21) Appl. No.: 17/415,500

(22) PCT Filed: Sep. 4, 2019

(86) PCT No.: PCT/KR2019/011404
§ 371 (c)(1),
(2) Date: Jun. 17, 2021

(87) PCT Pub. No.: WO2020/130286
PCT Pub. Date: Jun. 25, 2020

(65) Prior Publication Data

US 2022/0049854 A1 Feb. 17, 2022

(30) Foreign Application Priority Data

Dec. 20, 2018 (KR) ..... 10-2018-0165934

(51) Int. Cl.
*F24F 1/0014* (2019.01)
*F24F 1/0033* (2019.01)
(Continued)

(52) U.S. Cl.
CPC ..... *F24F 1/0014* (2013.01); *F24F 1/0033* (2013.01); *F24F 1/005* (2019.02); *F24F 13/20* (2013.01)

(58) Field of Classification Search
CPC ..... F24F 1/0014; F24F 1/0033; F24F 1/005; F24F 13/20
(Continued)

(56) References Cited

U.S. PATENT DOCUMENTS 4,493,341 A 1/1985 Wieland
7,334,424 B2 * 2/2008 Park ..... F24F 1/005 62/428
(Continued)

FOREIGN PATENT DOCUMENTS

CN 206160286 U 5/2017
CN 206222496 U 6/2017
(Continued)

OTHER PUBLICATIONS

European Search Report dated Dec. 22, 2021 in European Application No. 19 90 1350.
(Continued)

*Primary Examiner* — Allen R. B. Schult
(74) *Attorney, Agent, or Firm* — STAAS & HALSEY LLP

(57) ABSTRACT

Disclosed is an air conditioner. The disclosed air conditioner comprises: a main discharge port formed in a housing so as to discharge air introduced through a first inlet; a first guide discharge port configured to discharge a portion of air introduced through a second inlet such that the portion of the air introduced through the second inlet is mixed with the air discharged from the main discharge port; a second guide discharge port configured to discharge another portion of the air introduced through the second inlet such that the another portion of the air introduced through the second inlet is mixed with the air discharged from the main discharge port; and a distribution device configured to adjust the flow rate
(Continued)

of the air discharged through the first guide discharge port and the second guide discharge port.

15 Claims, 22 Drawing Sheets

(51) Int. Cl.
*F24F 1/005* (2019.01)
*F24F 13/20* (2006.01)

(58) Field of Classification Search
USPC ..... 454/338
See application file for complete search history.

(56) References Cited

U.S. PATENT DOCUMENTS

| | | | | |
|---|---|---|---|---|
| 9,551,498 | B2 * | 1/2017 | Kim | F24F 1/0011 |
| 10,508,658 | B2 * | 12/2019 | Park | F04D 29/403 |
| 2016/0184753 | A1 * | 6/2016 | Chu | F24F 1/0071 55/467 |
| 2018/0335221 | A1 | 11/2018 | Cho et al. | |

FOREIGN PATENT DOCUMENTS

| | | | |
|---|---|---|---|
| CN | 206959284 | U | 2/2018 |
| EP | 2 813 767 | A1 | 12/2014 |
| EP | 3 372 907 | A2 | 9/2018 |
| EP | 3 379 155 | A1 | 9/2018 |
| EP | 3 372 907 | A3 | 11/2018 |
| JP | 6-337133 | A | 12/1994 |
| JP | 3260941 | B2 | 2/2002 |
| JP | 6052519 | B2 | 12/2016 |
| KR | 10-2000-0055145 | A | 9/2000 |
| KR | 10-2000-0056578 | A | 9/2000 |
| KR | 10-1191414 | B1 | 10/2012 |
| KR | 10-2016-0051095 | A | 5/2016 |
| KR | 10-2017-0048128 | A | 5/2017 |
| KR | 10-2018-0097024 | A | 8/2018 |
| KR | 10-2018-0111362 | A | 10/2018 |
| KR | 10-2018-0125425 | A | 11/2018 |
| KR | 10-2018-0127223 | A | 11/2018 |

OTHER PUBLICATIONS

International Search Report dated Dec. 26, 2019, in corresponding International Patent Application No. PCT/KR2019/011404.
Office Action dated May 22, 2023, in Chinese Application No. 201980092553.5.
Office Action dated Jun. 24, 2022, issued in Chinese Application No. 201980092553.5.
Office Action dated Jan. 12, 2023, in Chinese Application No. 201980092553.5.
Office Action dated Aug. 11, 2023, in Korean Application No. 10-2018-0165934.
European Office Action dated Mar. 26, 2024, for European Application No. 19901350.9.

* cited by examiner

AIR CONDITIONER

CROSS-REFERENCE TO RELATED APPLICATIONS

This application is a U.S. National Stage Application which claims the benefit under 35 U.S.C. § 371 of International Patent Application No. PCT/KR2019/011404 filed on Sep. 4, 2019, which claims foreign priority benefit under 35 U.S.C. § 119 of Korean Patent Application 10-2018-0165934 filed on Dec. 20, 2018, in the Korean Intellectual Property Office, the contents of both of which are incorporated herein by reference.

TECHNICAL FIELD

The disclosure relates to air conditioners, and more particularly, to an air conditioner having various air discharging methods.

BACKGROUND ART

In general, air conditioners are devices that use a refrigeration cycle to adjust the temperature, humidity, air current, degree control, etc., to be suitable for human activity as well as remove dust or the like contained in the air. The refrigeration cycle involves a compressor, a condenser, an evaporator, an expansion valve, and a blower fan as primary elements.

The air conditioners may be classified into split air conditioners with indoor and outdoor units separately installed, and packaged air conditioners with indoor and outdoor units installed together in a single cabinet. The indoor unit of the split air conditioner includes a heat exchanger for exchanging heat of the air sucked into the panel, and a blower fan for sucking the room air into the panel and blowing out the air back into the room.

In the traditional air conditioner, when the air discharged from the indoor unit reaches directly to the user, the user may feel cold and unpleasant, and on the contrary when the user does not contact the air, the user may feel hot and unpleasant as well.

DISCLOSURE

Technical Problem

The disclosure provides an air conditioner having various air discharging methods.

The disclosure also provides an air conditioner for cooling or heating the room at minimum wind velocity at which the user feels pleasant. The disclosure also provides an air conditioner capable of providing mixed air of heat-exchanged air and indoor air.

The disclosure also provides an air conditioner capable of controlling direction of wind with a relatively simple structure.

Technical Solution

According to an aspect of the disclosure, an air conditioner includes a housing having a first inlet and a second inlet, a main discharge port formed at the housing to discharge air brought in from the first inlet, a first guide discharge port formed to discharge a portion of air brought in through the second inlet to be mixed with air discharged from the main discharge port, a second guide discharge port formed to discharge another portion of air brought in through the second inlet to be mixed with air discharged from the main discharge port, a heat exchanger arranged in a first fluid path formed between the first inlet and the main discharge port, a first blower device arranged to suck in air through the first inlet and discharge the air through the main discharge port, a second blower device arranged to suck in air through the second inlet and discharge the air through the first guide discharge port and the second guide discharge port, and a distribution device arranged to control a rate of flow of air discharged through the first guide discharge port and second guide discharge port.

The distribution device may be arranged in a portion of the housing from which the air brought in from the second inlet is branched toward the first guide discharge port and the second guide discharge port.

The air conditioner may further include a discharge panel arranged in a portion of the housing in which the main discharge port is formed, and having a plurality of discharge holes through which to discharge air discharged from the main discharge port at a slower rate than from the first guide discharge port and the second guide discharge port.

The first guide discharge port may be arranged on one side of the main discharge port, and the second guide discharge port may be arranged on the other side of the main discharge port.

The distribution device may be arranged to be adjacent to a fan discharge port of the second blower device.

The distribution device may include a damper driving source, and a damper moving or turning with power from the damper driving source and arranged to move or turn between a first position at which to block at least a portion of a second fluid path formed between the second inlet and the first guide discharge port and a second position at which to block at least a portion of a third fluid path formed between the second inlet and the second guide discharge port.

The distribution device may include a plurality of first dampers arranged to be able to block at least a portion of the first guide discharge port and placed in a direction to which the first guide discharge port extends, and a plurality of second dampers arranged to be able to block at least a portion of the second guide discharge port and placed in a direction to which the second guide discharge port extends.

The plurality of first dampers and the plurality of second dampers may be arranged to be rotated against the housing.

The first guide discharge port and the second guide discharge port may be formed on the same plane as a plane of the housing on which the main discharge port is formed.

The housing may include a first duct guiding a portion of air blown by the second blower device to the first guide discharge port and forming a second fluid path separated from the first fluid path, and a second duct guiding a portion of air blown by the second blower device to the second guide discharge port and forming a third fluid path separated from the first fluid path.

The air conditioner may further include a controller for controlling the distribution device, and the controller may control the distribution device to reduce a rate of flow of air discharged through the first guide discharge port when the direction of air discharged from the main discharge port is set to a side on which the first guide discharge port is formed, and control the distribution device to reduce a rate of flow of air discharged through the second guide discharge port when the direction of air discharged from the main discharge port is set to a side on which the second guide discharge port is formed.

The first blower device may include an axial fan, and the second blower device may include a centrifugal fan.

The second blower device may be arranged to be driven separately from the first blower device.

The heat exchanger may be arranged in the first fluid path between the first inlet and the first blower device.

The main discharge port may be arranged to discharge air that has exchanged heat with the heat exchanger, and the first guide discharge port may be arranged to discharge air that has not passed the heat exchanger.

According to another aspect of the disclosure, an air conditioner includes a housing having a first inlet and a second inlet, a main discharge port formed at the housing to discharge air brought in from the first inlet, a first guide discharge port formed to allow a portion of air brought in through the second inlet to be mixed with air discharged from the main discharge port and discharge the mixed air, a second guide discharge port formed to discharge another portion of air brought in through the second inlet to be mixed with air discharged from the main discharge port, a discharge panel arranged in a portion of the housing in which the main discharge port is formed, and having a plurality of discharge holes through which to discharge air discharged from the main discharge port at a slower rate than from the first guide discharge port and the second guide discharge port, a first blower device arranged to suck in air through the first inlet and discharge the air through the main discharge port, a second blower device arranged to suck in air through the second inlet and discharge the air through the first guide discharge port and the second guide discharge port, and a distribution device arranged to control a rate of flow of air discharged through the first guide discharge port and second guide discharge port.

The first guide discharge port may be arranged on the left-hand side of the main discharge port, and the second guide discharge port may be arranged on the right-hand side of the main discharge port.

The distribution device may include a damper arranged to move or turn between a first position at which to block at least a portion of a second fluid path formed between the second inlet and the first guide discharge port and a second position at which to block at least a portion of a third fluid path formed between the second inlet and the second guide discharge port.

The distribution device may be arranged to be adjacent to a fan discharge port of the second blower device.

In another aspect of the disclosure, an air conditioner includes a housing having a first inlet and a second inlet, a main discharge port formed at the housing to discharge air brought in from the first inlet, a first guide discharge port formed to allow a portion of air brought in through the second inlet to be mixed with air discharged from the main discharge port and discharge the mixed air, a second guide discharge port formed to discharge another portion of air brought in through the second inlet to be mixed with air discharged from the main discharge port, a first blower device arranged to suck in air through the first inlet and discharge the air through the main discharge port, a second blower device arranged to suck in air through the second inlet and discharge the air through the first guide discharge port and the second guide discharge port, and a distribution device arranged in a portion of the housing at which the air brought in from the second inlet is branched toward the first guide discharge port and the second guide discharge port to be able to adjust a rate of flow of air discharged through the first guide discharge port and the second guide discharge port.

Advantageous Effects

According to the disclosure, an air conditioner may include a main discharge port in which a discharge panel having a plurality of discharge holes is arranged and a guide discharge port through which to normally blow air, thereby having various air discharging methods.

According to the disclosure, an air conditioner may include a main discharge port in which a discharge panel having a plurality of discharge holes is arranged, thereby cooling or heating a room at minimum wind velocity at which the user feels pleasant.

According to the disclosure, an air conditioner may include a curved guide surface guiding air discharged from a guide discharge port to mix the air discharged through the guide discharge port with air discharged through a main discharge port, thereby providing mixed air of heat-exchanged air and indoor air.

According to the disclosure, an air conditioner may control wind direction with a relatively simple structure without an extra complicated structural part by controlling a distributed amount of air blown from a second fan to control the wind direction.

MODES OF THE INVENTION

Figure 1:
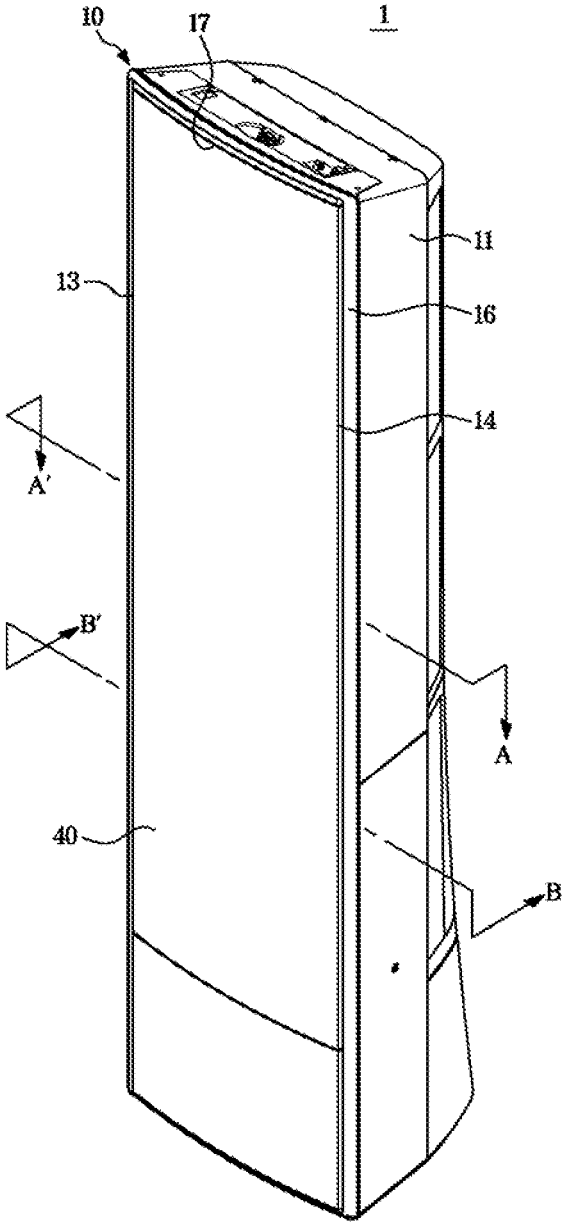
FIG. 1 shows an air conditioner, according to an embodiment of the disclosure.

Embodiments and features as described and illustrated in the disclosure are merely examples, and there may be various modifications replacing the embodiments and drawings at the time of filing this application.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or room discussed below could be termed a second element, component, region, layer or section without departing from the teachings of the disclosure. Descriptions shall be understood as to include any and all combinations of one or more of the associated listed items when the items are described by using the conjunctive term "~and/or ~," or the like.

The terms "front", "top or upper", "bottom or lower", "left" and "right" as herein used are defined with respect to the drawings, but the terms may not restrict the shape and position of the respective components.

A refrigeration cycle of an Air conditioner (AC) is comprised of a compressor, a condenser, an expansion valve, and an evaporator. A refrigeration cycle involves a series of processes having compression, condensing, expansion, and evaporation to supply conditioned air that has exchanged heat with a refrigerant.

A compressor compresses a gas refrigerant into a high temperature and high pressure state and discharges the compressed gas refrigerant, and the discharged gas refrigerant flows into a condenser. A condenser condenses the compressed gas refrigerant into a liquid state, releasing heat to the surroundings.

An expansion valve expands the high temperature and high pressure liquid refrigerant condensed by the condenser to low pressure liquid refrigerant. An evaporator evaporates the refrigerant expanded by the expansion valve and returns the low temperature and low pressure gas refrigerant to the compressor. The evaporator attains a cooling effect using latent heat of vaporization of the refrigerant to exchange heat with an object to be cooled. Through this refrigeration cycle, the air conditioner may control temperature in a room.

An outdoor unit of the air conditioner refers to a part comprised of the compressor and an outdoor heat exchanger of the refrigeration cycle. The indoor unit of the air conditioner may include an indoor heat exchanger, and the expansion valve may be located in any of the indoor unit and the outdoor unit. Indoor and outdoor heat exchangers serve as the condenser or the evaporator. When the indoor heat exchanger is used as the condenser, the air conditioner becomes a heater, and when the indoor heat exchanger is used as the evaporator, the air conditioner becomes a cooler.

Reference will now be made in detail to embodiments of the disclosure, which are illustrated in the accompanying drawings.

Figure 2:
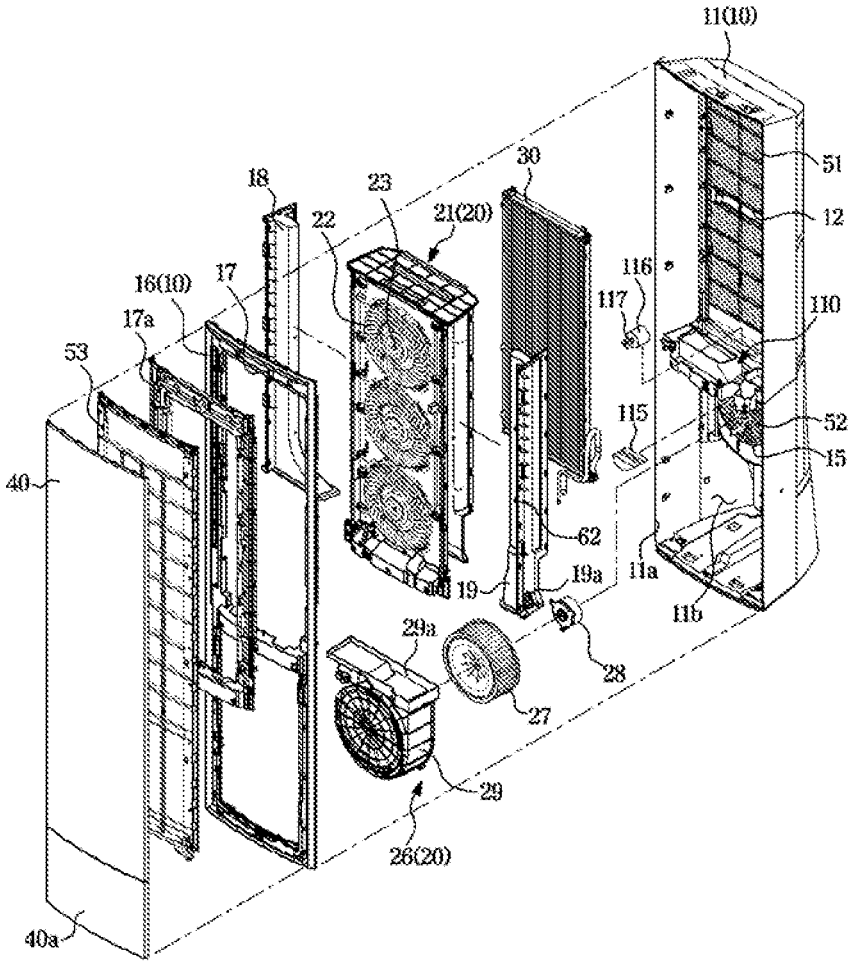
FIG. 2 is an exploded view of the air conditioner shown in FIG. 1.
Figure 3:
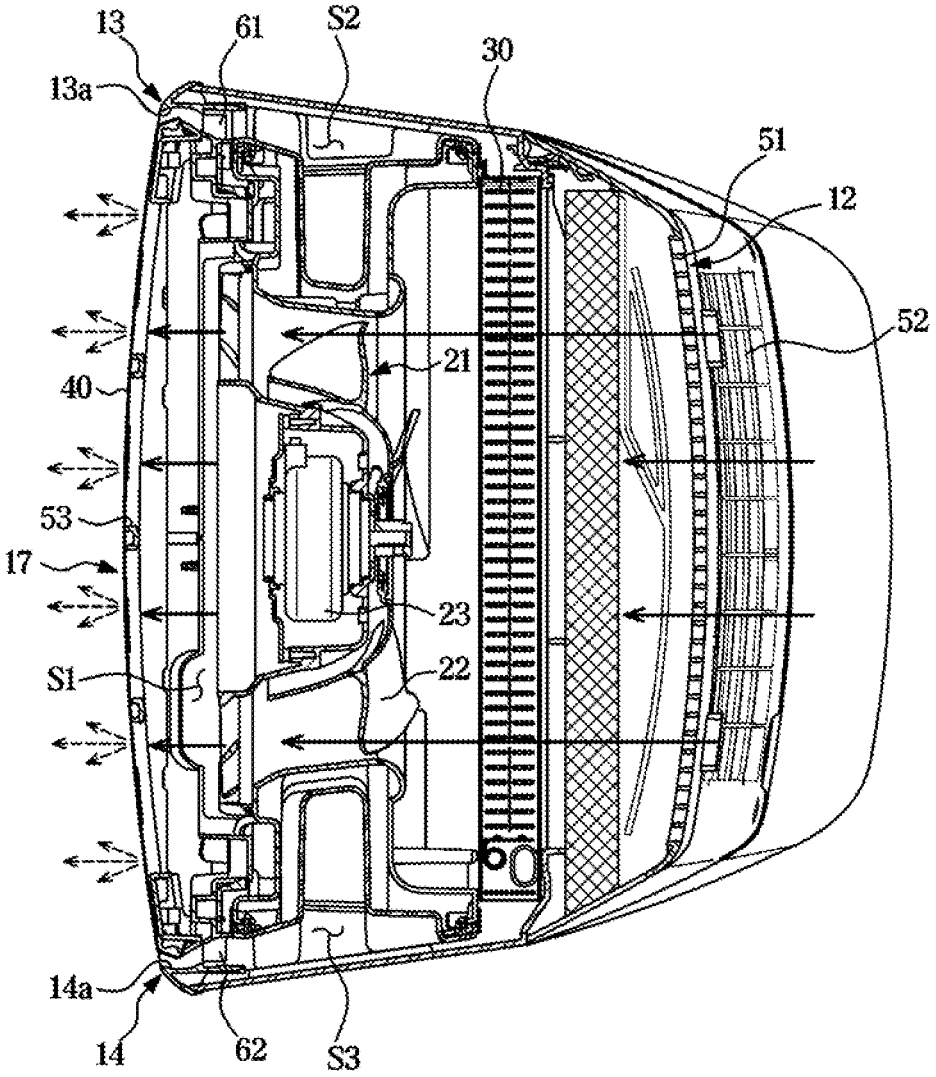
FIG. 3 is a cross-sectional view along line A-A' marked in FIG. 1, when the air conditioner shown in FIG. 1 is operated in a first mode.
Figure 4:
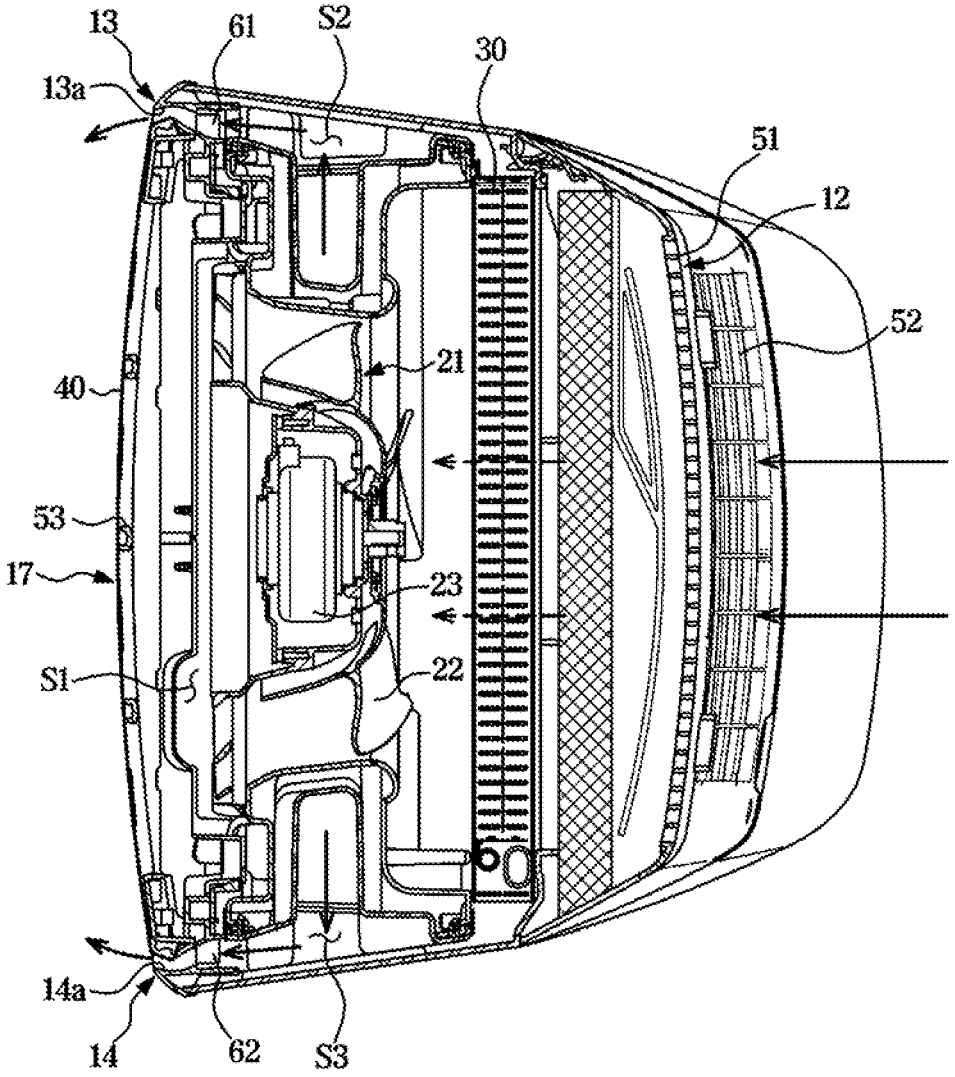
FIG. 4 is a cross-sectional view along line A-A' marked in FIG. 1, when the air conditioner shown in FIG. 1 is operated in a second mode.
Figure 5:
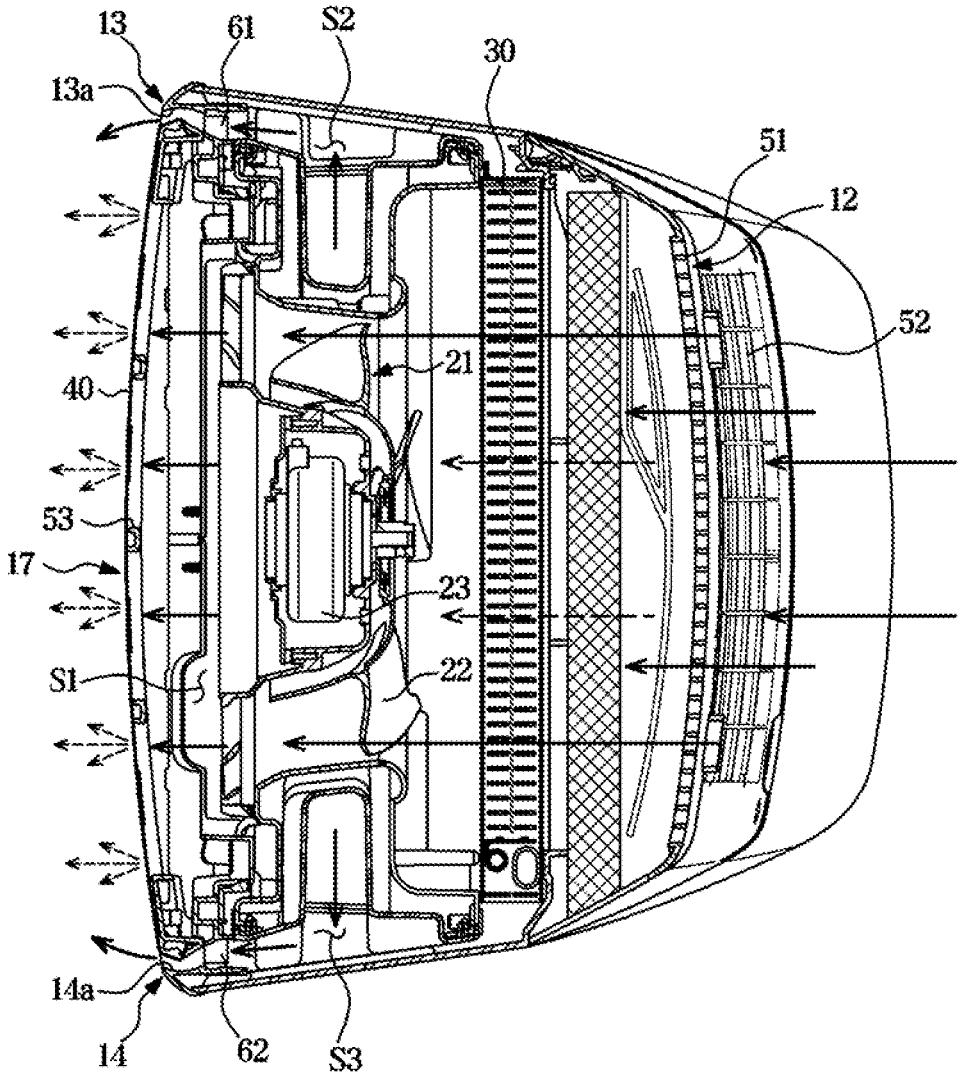
FIG. 5 is a cross-sectional view along line A-A' marked in FIG. 1, when the air conditioner shown in FIG. 1 is operated in a third mode.

FIG. 1 shows an air conditioner, according to an embodiment of the disclosure. FIG. 2 is an exploded view of the air conditioner shown in FIG. 1. FIG. 3 is a cross-sectional view along line A-A' marked in FIG. 1, when the air conditioner shown in FIG. 1 is operated in a first mode. FIG. 4 is a cross-sectional view along line A-A' marked in FIG. 1, when the air conditioner shown in FIG. 1 is operated in a second mode. FIG. 5 is a cross-sectional view along line A-A' marked in FIG. 1, when the air conditioner shown in FIG. 1 is operated in a third mode.

Referring to FIGS. 1 and 2, an air conditioner 1 may include a housing 10 that forms an external appearance, a blower device 20 for circulating air into or out of the housing 10, and a heat exchanger 30 for exchanging heat with air brought into the housing 10.

The housing 10 may include a body case 11 equipped with the blower device 20 and the heat exchanger 30, and a front panel 16 that covers the front of the body case 11. The housing 10 may include a first inlet 12, a second inlet 15, a main discharge port 17, and guide discharge ports 13 and 14.

The body case 11 may form a rear surface, both side surfaces, and a bottom surface of the air conditioner 1. The body case 11 has an open front, which may form a body case opening 11*a*, and the body case opening 11*a* may be covered by the front panel 16 and a discharge panel 40.

The front panel 16 may be coupled to the body case opening 11*a*. Although the front panel 16 is shown to be separable from the body case 11 in FIG. 2, the front panel 16 and the body case 11 may be integrally formed.

The main discharge port 17 may be formed at the front panel 16. The main discharge port 17 may be arranged on the front surface of the housing 10. The main discharge port 17 may penetrate the front panel 16. The main discharge port 17 may be formed in a top portion of the front panel 16. The main discharge port 17 may be positioned to be substantially opposite the first inlet 12. Air that has exchanged heat in the housing 10 may be discharged out of the housing 10 through the main discharge port 17. The main discharge port 17 may discharge the air brought in through the first inlet 12.

A panel support member 17*a* that supports the discharge panel 40 may be formed in a portion of the front panel 16 at which the main discharge port 17 is formed. The panel support member 17*a* may extend along edges of a first outlet. The panel support member 17*a* may support the rear surface of the discharge panel 40.

The first inlet 12 may be formed at the body case 11. The first inlet 12 may penetrate the rear surface of the body case 11. The first inlet 12 may be formed in an upper portion of the rear surface of the body case 11. Outside air may be brought into the housing 10 through the first inlet 12.

Although there are two first inlets 12 shown in FIG. 2, the number of the first inlets 12 is not limited thereto but may vary as required. Although the first inlet 12 is shown as being formed in square in FIG. 2, the shape of the first inlet 12 is not limited thereto but may vary as required.

The second inlet 15 may be formed at the body case 11. The second inlet 15 may penetrate the rear surface of the body case 11. The second inlet 15 may be formed in a lower portion of the rear surface of the body case 11. The second inlet 15 may be formed under the first inlet 12. Outside air may be brought into the housing 10 through the second inlet 15.

Like the first inlet 12, the number and/or shape of the second inlets 15 may vary as required.

The front panel 16 may form guide discharge ports 13 and 14 together with the discharge panel 40. The guide discharge ports 13 and 14 may be formed on the same plane as the main discharge port 17. The guide discharge ports 13 and 14 may be formed on the left and/or right side of the main discharge port 17. The guide discharge ports 13 and 14 may be arranged to be adjacent to the main discharge port 17. The guide discharge ports 13 and 14 may be arranged a certain distance away from the main discharge port 17. The guide discharge ports 13 and 14 may include the first guide discharge port 13 arranged on the left side of the main discharge port 17 and the second guide discharge port 14 arranged on the right side of the main discharge port 17.

The guide discharge ports 13 and 14 may extend in the vertical direction of the body case 11. The guide discharge ports 13 and 14 may have substantially the same length as the length of the main discharge port 17. Air that has not exchanged heat in the housing 10 may be discharged out of the housing 10 through the guide discharge ports 13 and 14. The guide discharge ports 13 and 14 may be arranged to discharge the air brought in through the second inlet 15.

The guide discharge ports 13 and 14 may be formed to mix air discharged from the guide discharge ports 13 and 14 with air discharged from the main discharge port 17. Specifically, curved guide surfaces 13*a* and 14*a* (see FIG. 3) may be included in a portion of the front panel 16 forming the guide discharge ports 13 and 14 to guide the air discharged from the guide discharge ports 13 and 14 to be mixed with the air discharged from the main discharge port 17.

The air discharged through the guide discharge ports 13 and 14 may be discharged along the curved guide surfaces 13*a* and 14*a* to a direction in which the air may be mixed with the air discharged from the main discharge port 17. The curved guide surfaces 13*a* and 14*a* may guide the air discharged through the guide discharge ports 13 and 14 to substantially the same direction as the air discharged through the main discharge port 17. The curved guide surfaces 13*a* and 14*a* may be arranged to guide the air discharged through the guide discharge ports 13 and 14 forward.

There may be blades 61 and 62 (see FIG. 3) provided in the guide discharge ports 13 and 14 to guide the air discharged through the guide discharge ports 13 and 14. The blades 61 and 62 may be successively arranged in a direction of length of the guide discharge ports 13 and 14. The first blade 61 may be arranged in the first guide discharge port 13, and the second blade 62 may be arranged in the second guide discharge port 14.

An air fluid path connecting the first inlet 12 to the main discharge port 17 is called a first fluid path S1; an air fluid path connecting the second inlet 15 to the first guide discharge port 13 is called a second fluid path S2; an air fluid path connecting the second inlet 15 to the second guide discharge port 14 is called a third fluid path S3. The first fluid path S1 may be separated from the second fluid path S2 and the third fluid path S3. Accordingly, air flowing in the first fluid path S1 may not be mixed with the air flowing in the second fluid path S2 and the third fluid path S3. The second fluid path S2 and the third fluid path S3 may have some overlapping sections. Specifically, the second fluid path S2 and the third fluid path S3 may share a section from the second inlet 15 to a second blower device 26.

A first duct 18 may be arranged in the housing 10 to separate the first fluid path S1 from the second fluid path S2. The first duct 18 may be arranged on the left of the first blower device 21. The first duct 18 may extend in the vertical direction. The first duct 18 may be connected to the second blower device 26. The first duct 18 may be connected to a fan discharge port 29*a* of the second blower device 26. The first duct 18 may guide a portion of air blown by the second blower device 26 to the first guide discharge port 13. The first duct 18 may be equipped with a first duct filter (not shown) to filter out foreign materials from the air brought in from the second blower device 26.

A second duct 19 may be arranged in the housing 10 to separate the first fluid path S1 from the third fluid path S3. The second duct 19 may be arranged on the right of the first blower device 21. The second duct 19 may extend in the vertical direction. The second duct 19 may be connected to the second blower device 26. The second duct 19 may be connected to a fan discharge port 29*a* of the second blower device 26. The second duct 19 may guide a portion of air blown by the second blower device 26 to the second guide discharge port 14. The second duct 19 may be equipped with a second duct filter 19*a* to filter out foreign materials from the air brought in from the second blower device 26.

The air conditioner 1 may discharge air that has exchanged heat with the heat exchanger 30 through the main discharge port 17 and discharge air that has not gone through the heat exchanger 30 through the guide discharge ports 13 and 14. That is, the guide discharge ports 13 and 14 may be arranged to discharge the air that has not exchanged heat. As the heat exchanger 30 is arranged in the first fluid path S1, the air discharged through the main discharge port 17 may be heat-exchanged air. The second fluid path S2 and the third fluid path S3 have no heat exchanger arranged therein, so the air discharged through the guide discharge ports 13 and 14 may be air that has not exchanged heat.

Alternatively, in the disclosure, the heat-exchanged air may be discharged through the guide discharge ports 13 and 14. In other words, heat exchangers may be arranged in the second fluid path S2 and the third fluid path S3 as well. Specifically, the heat exchangers for exchanging heat with air to be discharged through the guide discharge ports 13 and 14 may be arranged in a receiving space 11*b* of the body case 11. With this structure, the air conditioner 1 may provide heat-exchanged air through both the main discharge port 17 and the guide discharge ports 13 and 14.

The body case 11 may have a shape that has increasing horizontal cross-sections toward the bottom. With this shape, the housing 10 may be stably supported against the floor.

The receiving space 11*b* may be formed in the body case 11 to have electric parts (not shown) arranged therein. Electric parts required for operating the air conditioner 1 may be arranged in the receiving space 11*b*. The second blower device 26 may be arranged in the receiving space 11*b*.

The blower device 20 may include the first blower device 21 and the second blower device 26. The second blower device 26 may be provided to be driven separately from the first blower device 21. The rotational speed of the second blower device 26 may be different from the rotational speed of the first blower device 21.

The first blower device 21 may be placed in the first fluid path S1 formed between the first inlet 12 and the main discharge port 17. Air may be brought by the first blower device 21 into the housing 10 through the first inlet 12. The air brought in through the first inlet 12 may be moved along the first fluid path S1 and discharged out of the housing 10 through the main discharge port 17. The first blower device 21 may include a first fan 22 and a first fan driver 23.

The first fan 22 may employ an axial fan or a mixed flow fan. However, the type of the first fan 22 is not limited thereto as long as the first fan 22 has a structure to move the air brought in from the outside of the housing 10 to be discharged back to the outside from the housing 10. For example, the first fan 22 may be a cross fan, a turbo fan, or a sirocco fan.

Although there are three first fans 22 in FIG. 2, the number of the first fans 22 is not limited thereto but may vary as required.

The first fan driver 23 may drive the first fan 22. The first fan driver 23 may be arranged in the center of the first fan 22. The first fan driver 23 may include a motor.

The second blower device 26 may be placed in the second fluid path S2 and the third fluid path S3 formed between the second inlet 15 and the guide discharge ports 13 and 14. Air may be brought by the second blower device 26 into the housing 10 through the second inlet 15. A portion of the air brought in through the second inlet 15 may be moved along the second fluid path S2 and discharged out of the housing 10 through the first guide discharge port 13, or may be moved along the third fluid path S3 and discharged out of the housing 10 through the second guide discharge port 14.

Figure 6:
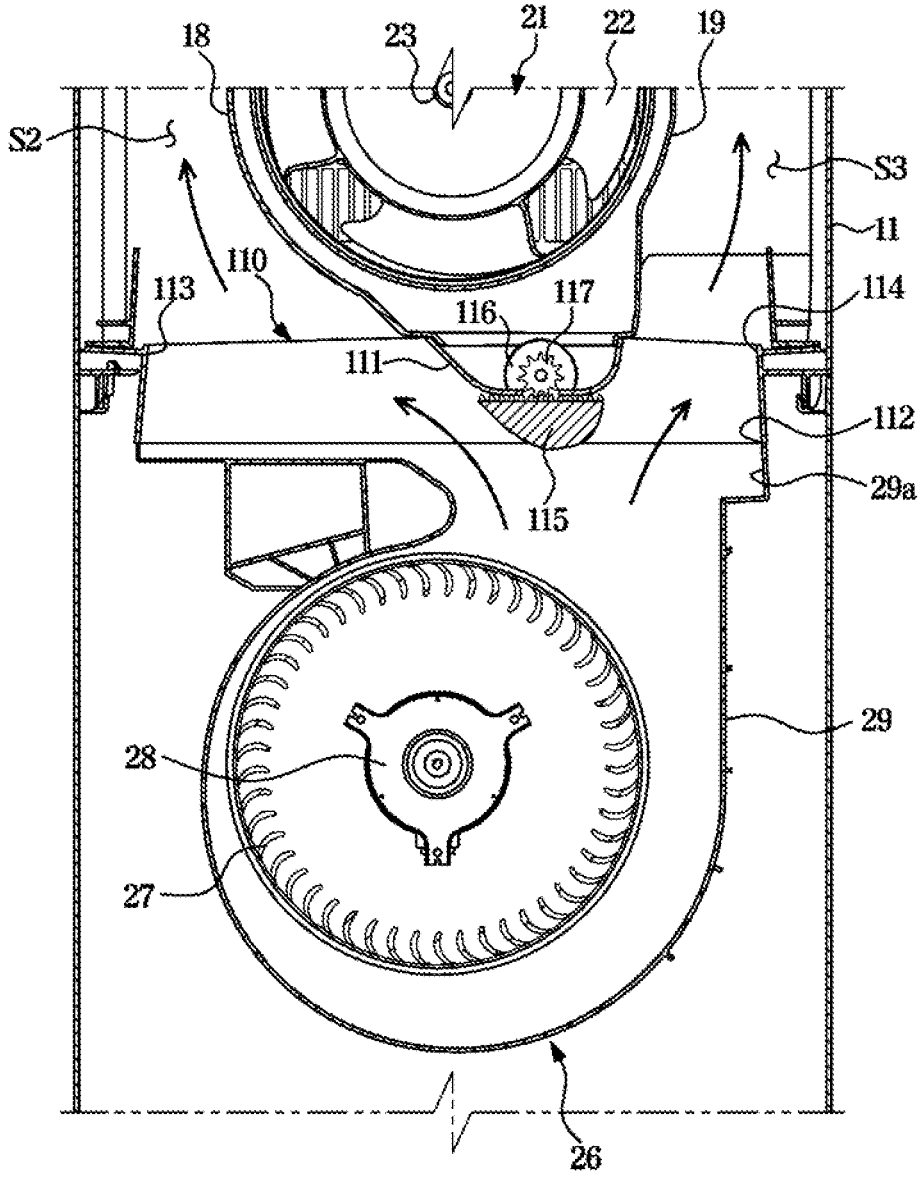
FIG. 6 is part of a cross-sectional view along line B-B' marked in FIG. 1, when the air conditioner shown in FIG. 1 is operated in the third mode to provide a central air current.

Referring to FIG. 6, the second blower device 26 may include a second fan 27 and a second fan driver 29, and a fan body case 29.

The second fan 27 may employ a centrifugal fan. However, the type of the second fan 27 is not limited thereto as long as the second fan 27 has a structure to move the air brought in from the outside of the housing 10 to be discharged back to the outside from the housing 10. For example, the second fan 27 may be a cross fan, a turbo fan, or a sirocco fan.

Although there are two second fans 27 in FIG. 2, the number of the second fans 27 is not limited thereto but may vary as required.

The second fan driver 28 may drive the second fan 27. The second fan driver 28 may be arranged in the center of the second fan 27. The second fan driver 28 may include a motor.

The fan body case 29 may cover the second fan 27. The fan body case 29 may include a fan inlet (not shown) through which air is brought in, and the fan discharge port 29*a* through which air is discharged. Positions in which the fan inlet and the fan discharge port 29*a* are formed may be determined depending on the type of the second fan 27.

The heat exchanger 30 may be arranged between the first blower device 21 and the first inlet 12. The heat exchanger 30 may be arranged in the first fluid path S1. The heat exchanger 30 may absorb heat from the air brought in through the first inlet 12, or transfer heat to the air brought in through the first inlet 12. The heat exchanger 30 may include a tube and a header coupled to the tube. The type of the heat exchanger 30 is not, however, limited thereto.

The air conditioner 1 may include the discharge panel 40 arranged in a portion of the front panel 16 at which the main discharge port 17 is formed. The discharge panel 40 may include a plurality of discharge holes through which to discharge air discharged from the main discharge port 17 at a slower rate than the air discharged from the guide discharge ports 13 and 14. The plurality of discharge holes may penetrate inner and outer surfaces of the discharge panel 40. The plurality of discharge holes may be formed in a minute size. The plurality of discharge holes may be uniformly distributed in the whole area of the discharge panel 40. The heat exchanged air discharged through the main discharge port 17 may be discharged through the plurality of discharge holes at a uniformly low rate. A blocking portion 40*a* in which the plurality of discharge holes are not formed may be arranged in a lower portion of the discharge panel 40.

The air conditioner 1 may include a first sucking grill 51 coupled to a portion in which the first inlet 12 of the body case 11 is formed. The first sucking grill 51 may be provided to prevent foreign materials from being brought in through the first inlet 12. For this, the first sucking grill 51 may include a plurality of slits or holes. The first sucking grill 51 may be arranged to cover the first inlet 12.

The air conditioner 1 may include a second sucking grill 52 coupled to a portion in which the second inlet 15 of the body case 11 is formed. The second sucking grill 52 may be provided to prevent foreign materials from being brought in through the second inlet 15. For this, the second sucking grill 52 may include a plurality of slits or holes. The second sucking grill 52 may be arranged to cover the second inlet 15.

The air conditioner 1 may include a discharge grill 53 coupled to a portion in which the first outlet 17 of the front panel 16 is formed. The discharge grill 53 may be installed at the panel support member 17*a*. The discharge grill 53 may be provided to prevent foreign materials from being discharged through the first outlet 17. For this, the discharge grill 53 may include a plurality of slits or holes. The discharge grill 53 may be arranged to cover the first outlet 17.

Referring to FIGS. 3 to 5, operation of the air conditioner 1 will be described.

Referring first to FIG. 3, the air conditioner 1 may be operated in a first mode in which to discharge heat-exchanged air only through the main discharge port 17. The discharge panel 40 is arranged in the main discharge port 17, so air conditioning of a room may be slowly performed as a whole. Specifically, when air is discharged out of the housing 10 through the main discharge port 17, the wind velocity of the air may be reduced while the air is passing through the plurality of discharge holes so that the air may be discharged at a low rate. With this structure, the room may be cooled or heated at a wind velocity that gives the user a pleasant feeling.

Specifically, as the first blower device 21 is driven, outside air of the housing 10 may be brought into the housing 10 through the first inlet 12. The air brought into the housing 10 may exchange heat while passing the heat exchanger 30. The air that has exchanged heat while passing the heat exchanger 30 may be discharged out of the housing 10 through the main discharge port 17 at a rate that has been reduced when passing the discharge panel 40. That is, the heat-exchanged air having passed the first fluid path S1 may be discharged at a wind velocity that may give the user a pleasant feeling.

The second blower device 26 is not operated in the first mode, air is not discharged through the guide discharge ports 13 and 14.

Referring to FIG. 4, the air conditioner 1 may be operated in a second mode in which to discharge air that has not exchanged heat only through the guide discharge ports 13 and 14. The second fluid path S2 and the third fluid path S3 have no heat exchanger arranged therein, so the air conditioner 1 may circulate indoor air.

As the guide discharge ports 13 and 14 are equipped with the curved guide surfaces 13*a* and 14*a*, the air may be discharged forward from the air conditioner 1 through the guide discharge ports 13 and 14. The blades 61 and 62 are arranged in the guide discharge ports 13 and 14, so the air may be blown farther forward.

Specifically, as the second blower device 26 is operated, outside air of the housing 10 may be brought into the housing 10 through the second inlet 15. The air brought into the housing 10 may pass the second blower device 26 and may then be moved to the second fluid path S2 and the third fluid path S3 formed on either side of the first fluid path S1. The air may be moved up the second fluid path S2 and the third fluid path S3, and then discharged out of the housing 10 through the guide discharge ports 13 and 14. In this case, the air may be guided forward from the air conditioner 1 along the curved guide surfaces 13*a* and 14*a*.

The first blower device 21 is not operated in the second mode, the air is not discharged through the main discharge port 17. Specifically, the air conditioner 1 blows air that has not exchanged heat in the second mode, thereby performing a simple function of circulating indoor air or providing strong wind for the user.

Referring to FIG. 5, the air conditioner 1 may be operated in a third mode in which to discharge heat-exchanged air through the main discharge port 17 and the guide discharge ports 13 and 14. The air conditioner 1 may discharge cold air further away in the third mode than operated in the first mode.

Specifically, when the air conditioner 1 is operated in the third mode, the cold air or heated air discharged through the main discharge port 17 may be mixed with the air discharged through the guide discharge ports 13 and 14. Furthermore, the air discharged through the guide discharge ports 13 and 14 has a higher rate than the air discharged through the main discharge port 17, so the air discharged through the guide discharge ports 13 and 14 may move the heat-exchanged air discharged through the main discharge port 17 further away.

With this structure, the air conditioner 1 may provide the user with pleasantly cool air or warm air resulting from mixture of the heat-exchanged air and the indoor air.

In addition, the air conditioner 1 may be configured to provide cool air to various ranges by changing driving power for the first blower device 21 and/or the second blower device 26. Specifically, the first blower device 21 may be arranged to control a volume and/or a rate of air discharged through the main discharge port 17, and the second blower device 26 may be arranged to control a volume and/or a rate of air discharged through the guide discharge ports 13 and 14.

For example, when a volume and/or a rate of the air discharged from the guide discharge ports 13 and 14 is increased by increasing driving power for the second blower device 26, the air conditioner 1 may move the heat-exchanged air further away. On the other hand, when a volume and/or a rate of the air discharged from the guide discharge ports 13 and 14 is reduced by reducing driving power for the second blower device 26, the air conditioner 1 may provide the heat-exchanged air to a relatively close area.

Figure 7:
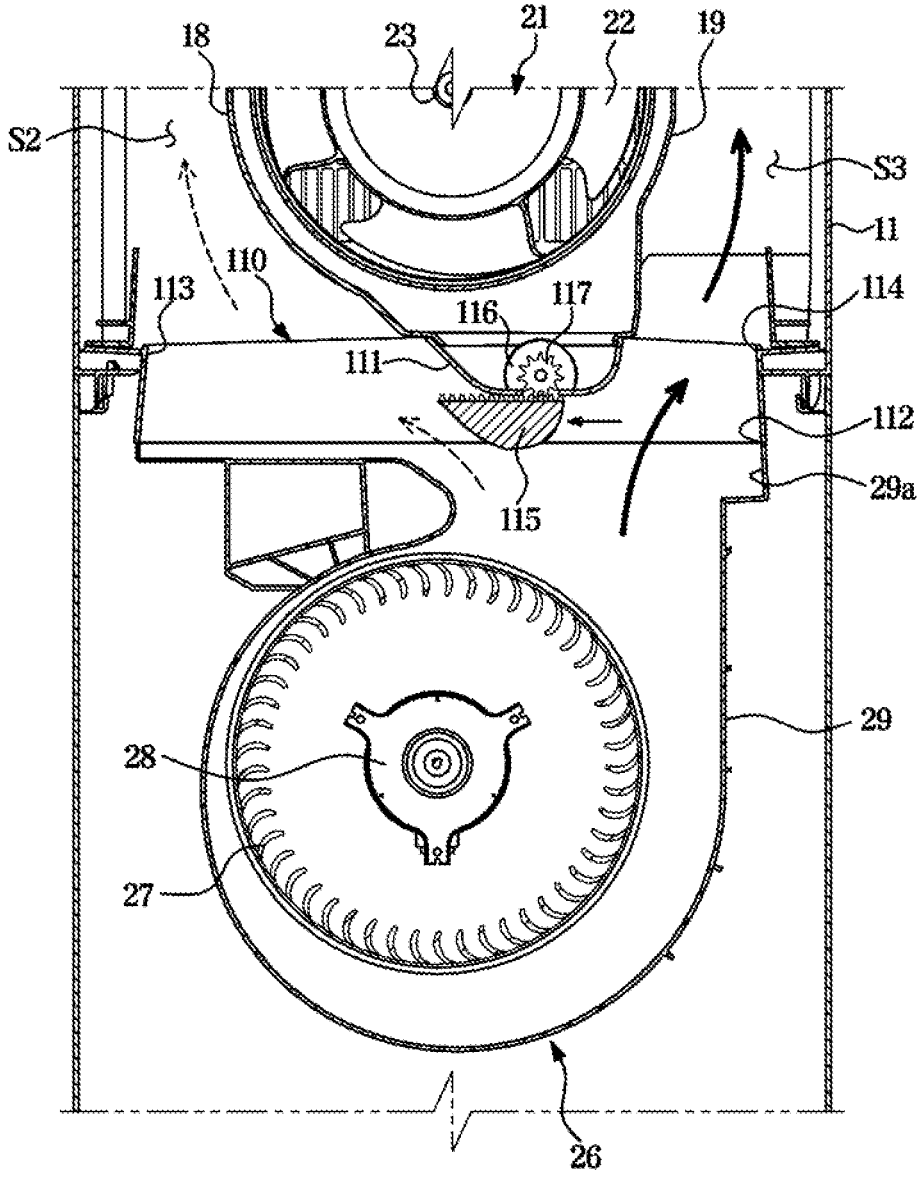
FIG. 7 is part of a cross-sectional view along line B-B' marked in FIG. 1, when the air conditioner shown in FIG. 1 is operated in the third mode to provide a left air current.
Figure 8:
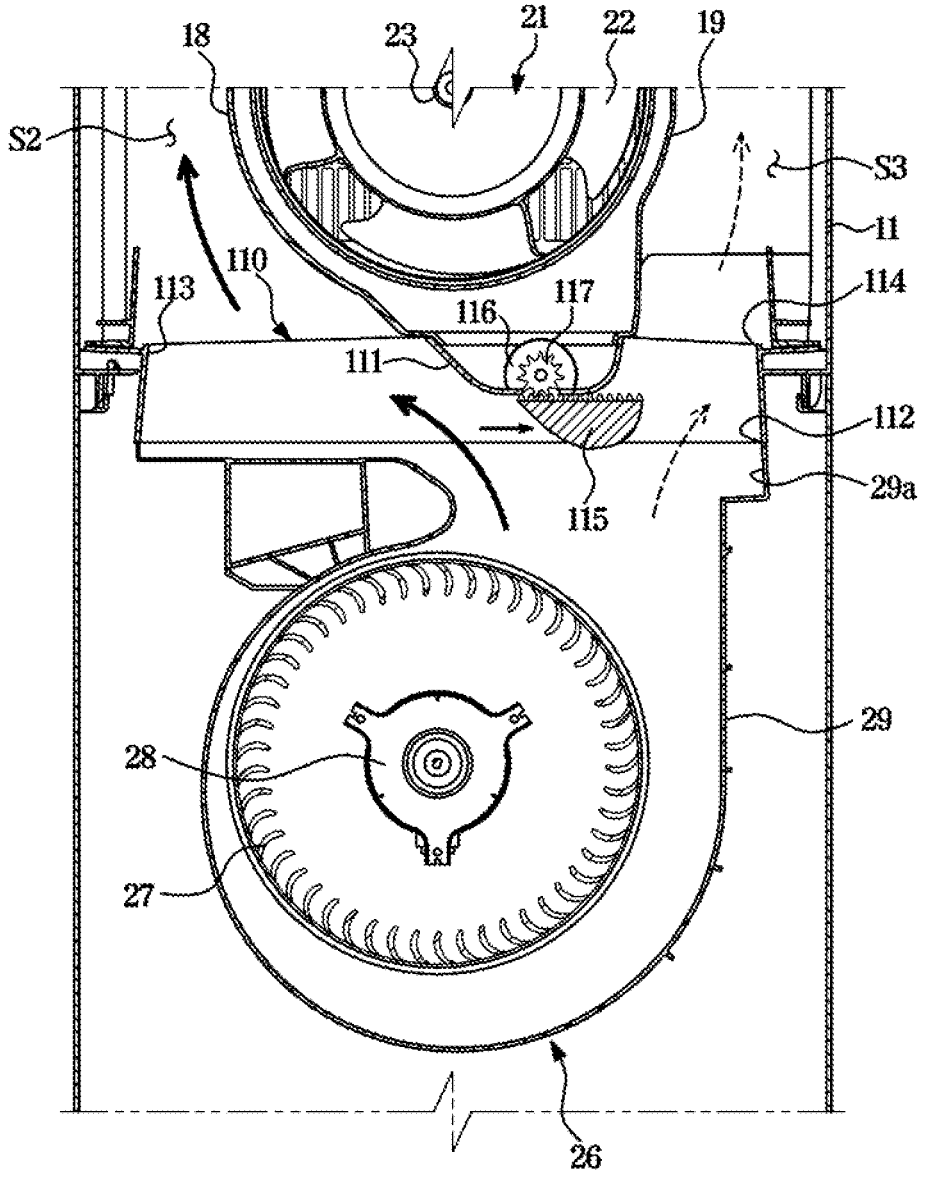
FIG. 8 is part of a cross-sectional view along line B-B' marked in FIG. 1, when the air conditioner shown in FIG. 1 is operated in the third mode to provide a right air current.
Figure 9:
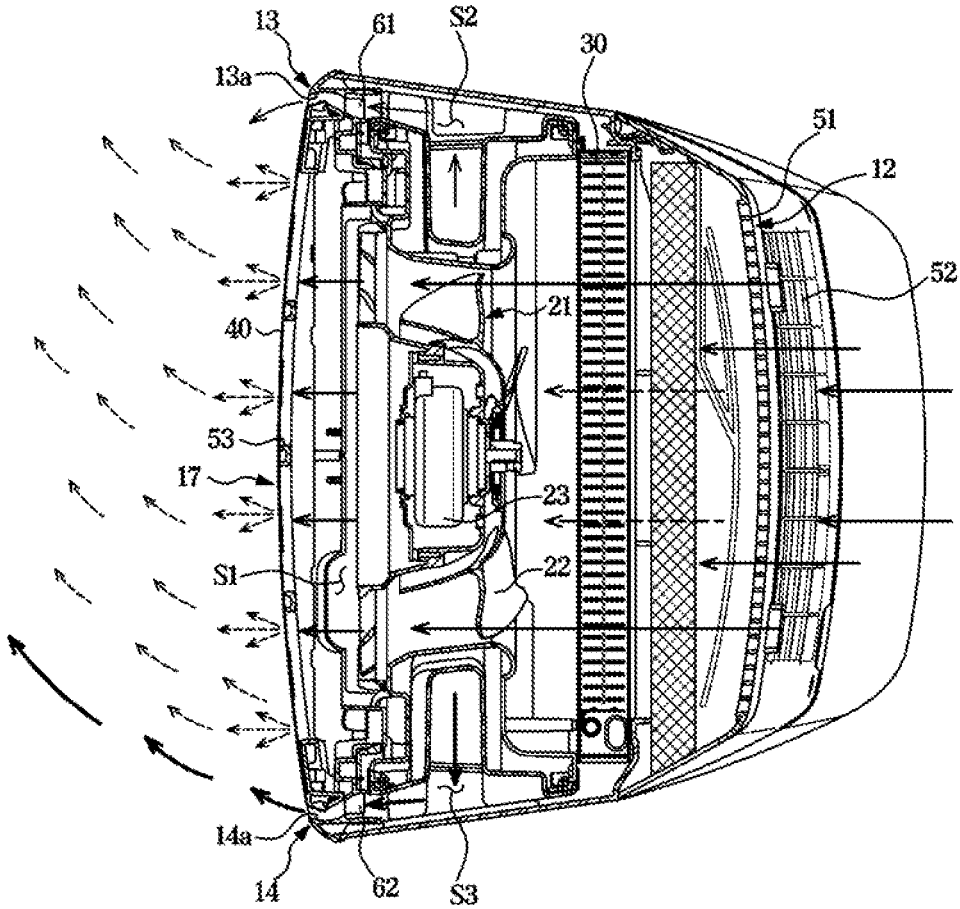
FIG. 9 is a cross-sectional view along line A-A' marked in FIG. 1, when the air conditioner shown in FIG. 1 is operated in a state shown in FIG. 7.
Figure 10:
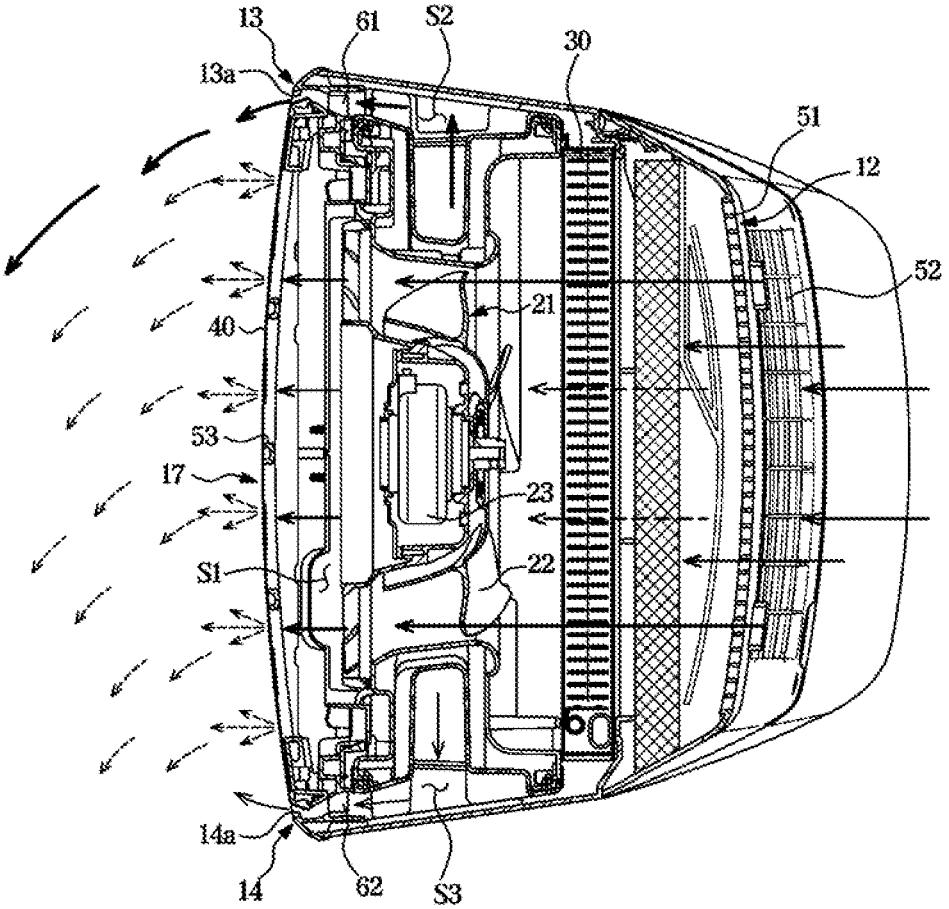
FIG. 10 is a cross-sectional view along line A-A' marked in FIG. 1, when the air conditioner shown in FIG. 1 is operated in a state shown in FIG. 8.
Figure 11:
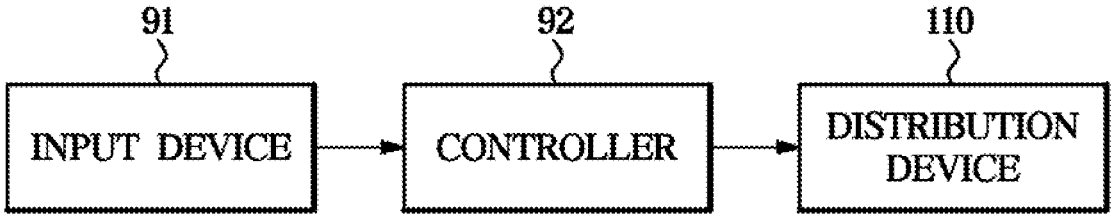
FIG. 11 is a control block diagram of a distribution device shown in FIG. 6.

FIG. 6 is part of a cross-sectional view along line B-B' marked in FIG. 1, when the air conditioner shown in FIG. 1 is operated in the third mode to provide a central air current. FIG. 7 is part of a cross-sectional view along line B-B' marked in FIG. 1, when the air conditioner shown in FIG. 1 is operated in the third mode to provide a left air current. FIG. 8 is part of a cross-sectional view along line B-B' marked in FIG. 1, when the air conditioner shown in FIG. 1 is operated in the third mode to provide a right air current. FIG. 9 is a cross-sectional view along line A-A' marked in FIG. 1, when the air conditioner shown in FIG. 1 is operated in a state shown in FIG. 7. FIG. 10 is a cross-sectional view along line A-A' marked in FIG. 1, when the air conditioner shown in FIG. 1 is operated in a state shown in FIG. 8. FIG. 11 is a control block diagram of a distribution device shown in FIG. 6.

Referring to FIGS. 2 to 6, the air conditioner 1 may include a distribution device 110. The distribution device 110 may be arranged in the housing 10. The distribution device 110 may be arranged in the receiving space 11*b* of the body case 11. The distribution device 110 may be arranged to be adjacent to the fan discharge port 29 of the second blower device 26. The distribution device 110 may be arranged in a portion from which the air brought in from the second inlet 15 is branched toward the first guide discharge port 13 and the second guide discharge port 14. The distribution device 110 may be arranged between the first inlet 12 and the second inlet 15. The distribution device 110 may be arranged to distribute air blown by the second blower device 26 into the first duct 18 and the second duct 19.

The distribution device 110 may be arranged to control a flow rate of the air discharged through the first guide discharge port 13 and the second guide discharge port 14.

The distribution device 110 may include a distribution case 111 mounted in the body case 11. The distribution case 111 may include a distribution inlet 112 connected to the second blower device 26, a first distribution outlet 113 connected to the first duct 18, and a second distribution outlet 114 connected to the second duct 19. The distribution case 111 may be formed to distribute the air brought in through the distribution inlet 112 into the first distribution outlet 113 and the second distribution outlet 114.

The distribution inlet 112 may be formed when the bottom of the distribution case 111 is opened. The distribution inlet 112 may be connected to the fan discharge port 29*a* of the second blower device 26. The air blown by the second blower device 26 may be brought into the distribution device 110 through the distribution inlet 112.

The first distribution outlet 113 may be formed when a portion of the top of the distribution case 111 is opened. The first distribution outlet 113 may be connected to the first duct 18. A portion of the air brought into the distribution device 110 through the distribution inlet 112 may be discharged into the first duct 18 through the first distribution outlet 113.

The second distribution outlet 114 may be formed when another portion of the top of the distribution case 111 is opened. The second distribution outlet 114 may be connected to the second duct 19. Another portion of the air brought into the distribution device 110 through the distribution inlet 112 may be discharged into the second duct 19 through the second distribution outlet 114.

The distribution device 110 may include a damper 115 for controlling a volume of air discharged to the first duct 18 and the second duct 19, a damper driving source 116, and a power transfer member 117.

The damper 115 may be arranged to be movable in a path in which the air brought in through the distribution inlet 112 is moved to the first distribution outlet 113 and the second distribution outlet 114.

The damper 115 may be in a first position to block at least a portion of the second fluid path S2 formed between the second inlet 15 and the first guide discharge port 13, as shown in FIG. 7. In other words, the damper 115 may be in the first position to block at least a portion of a fluid path connecting the distribution inlet 112 to the first distribution outlet 113.

The damper 115 may be in a second position to block at least a portion of the third fluid path S3 formed between the second inlet 15 and the second guide discharge port 14, as shown in FIG. 8. In other words, the damper 115 may be in the second position to block at least a portion of a fluid path connecting the distribution inlet 112 to the second distribution outlet 114.

The damper driving source 116 may generate power to move the damper 115. The damper driving source 116 may include a motor 116.

The power transfer member 117 may transfer power generated by the damper driving source 116 to the damper 115. Although the power transfer member 117 is shown in FIG. 6 as including a rack gear formed at the damper 115 and a pinion gear coupled to the damper driving source 116, it is not limited thereto as long as it has a structure that allows the power of the damper driving source 116 to be transferred to the damper 115.

With this structure, when the air conditioner 1 is going to discharge heat-exchanged air along the center as shown in FIG. 5, the damper 115 may be placed between the first position and the second position. Hence, the air blown from the second blower device 26 may be almost uniformly distributed into the first duct 18 and the second duct 19, so that an amount of air discharged through the first guide discharge port 13 may be almost the same as an amount of air discharged through the second guide discharge port 14.

On the other hand, when the air conditioner 1 is going to discharge the heat-exchanged air to the left side on which the first guide discharge port 13 is arranged as shown in FIG. 9, the damper 115 may be placed in the first position to block at least a portion of the air moved to the first distribution outlet 113. Hence, more of the air blown from the second blower device 26 may be moved to the second duct 19 than to the first duct 18, so that an amount of air discharged through the second guide discharge port 14 may be greater than an amount of air discharged through the first guide discharge port 13. Accordingly, pressure on the side of the first guide discharge port 13 is reduced, and the air discharged from the second guide discharge port 14 may be moved toward the left along with the air discharged from the main discharge port 17.

On the other hand, when the air conditioner 1 is going to discharge the heat-exchanged air to the right side on which the second guide discharge port 14 is arranged as shown in FIG. 10, the damper 115 may be placed in the second position to block at least a portion of the air moved to the second distribution outlet 114. Hence, more of the air blown from the second blower device 26 may be moved to the first duct 18 than to the second duct 19, so that an amount of air discharged through the first guide discharge port 13 may be greater than an amount of air discharged through the second guide discharge port 14. Accordingly, pressure on the side of the second guide discharge port 14 is reduced, and the air discharged from the first guide discharge port 13 may be moved toward the right along with the air discharged from the main discharge port 17.

Specifically, referring to FIG. 11, the air conditioner 1 may include an input device 91 for receiving a command from the user, and a controller 92 configured to control the distribution device 110. The user may input a command about a wind direction of the air conditioner 1 through the input device 91. The input device 91 may send the input command to the controller 92. Upon reception of the command, the controller 92 may drive the damper driving source 116 of the distribution device 110 to move the damper 114.

Specifically, when the user set a wind direction through the input device 91 so that the air conditioner 1 is directed to a side on which the first guide discharge port 13 is formed, the controller 92 may control the damper 115 to be placed in the second fluid path S2 in order to reduce a flow rate of the air discharged through the first guide discharge port 13. On the other hand, when the user set a wind direction through the input device 91 so that the air conditioner 1 is directed to a side on which the second guide discharge port 14 is formed, the controller 92 may control the damper 115 to be placed in the third fluid path S3 in order to reduce a flow rate of the air discharged through the second guide discharge port 14.

Furthermore, the air conditioner 1 may control the damper 115 of the distribution device 110 to be moved back and forth continuously between the first position and the second position, thereby discharging the heat-exchanged air to a wider area.

Specifically, the controller 92 may control the position of the damper 115 so that 20% and 80% of the air blown by the second blower device 26 may be distributed into the second fluid path S2 and the third fluid path S3, respectively. Subsequently, the controller 92 may control the damper 115 to increase a flow rate of air flowing in the second fluid path S2. After this, when 80% and 20% of the air blown by the second blower device 26 flow into the second fluid path S2 and the third fluid path S3, respectively, the controller 92 may move the damper 115 in the opposite direction. In other words, the controller 92 may move the damper 115 to reduce a flow rate of air flowing in the second fluid path S2. After this, when a flow rate of the air flowing in the second fluid path S2 reaches 20%, the controller 92 may make the damper 115 move back in the opposite direction.

When the damper 115 is operated as described above, the wind direction of the air conditioner 1 may be continuously changed from left to right and from right to left, so that the heat-exchanged air may spread to a wider area.

With this structure, the air conditioner 1 according to an embodiment of the disclosure may control wind direction of the heat-exchanged air without an extra structural part in the guide discharge ports 13 and 14.

Figure 12:
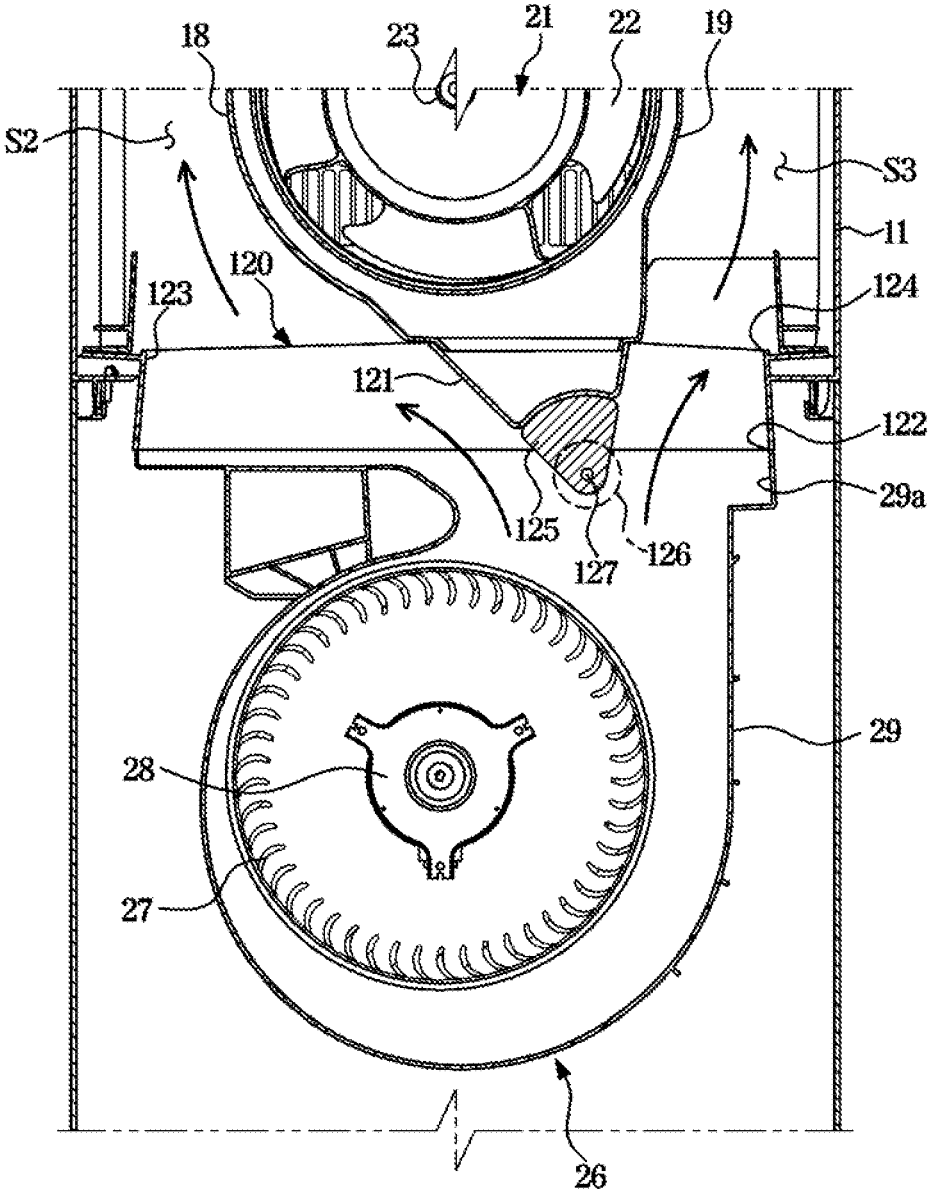
FIG. 12 is part of a cross-sectional view along line B-B' marked in FIG. 1, when an air conditioner including a distribution device is operated in the third mode to provide a central air current, according to another embodiment of the disclosure.
Figure 13:
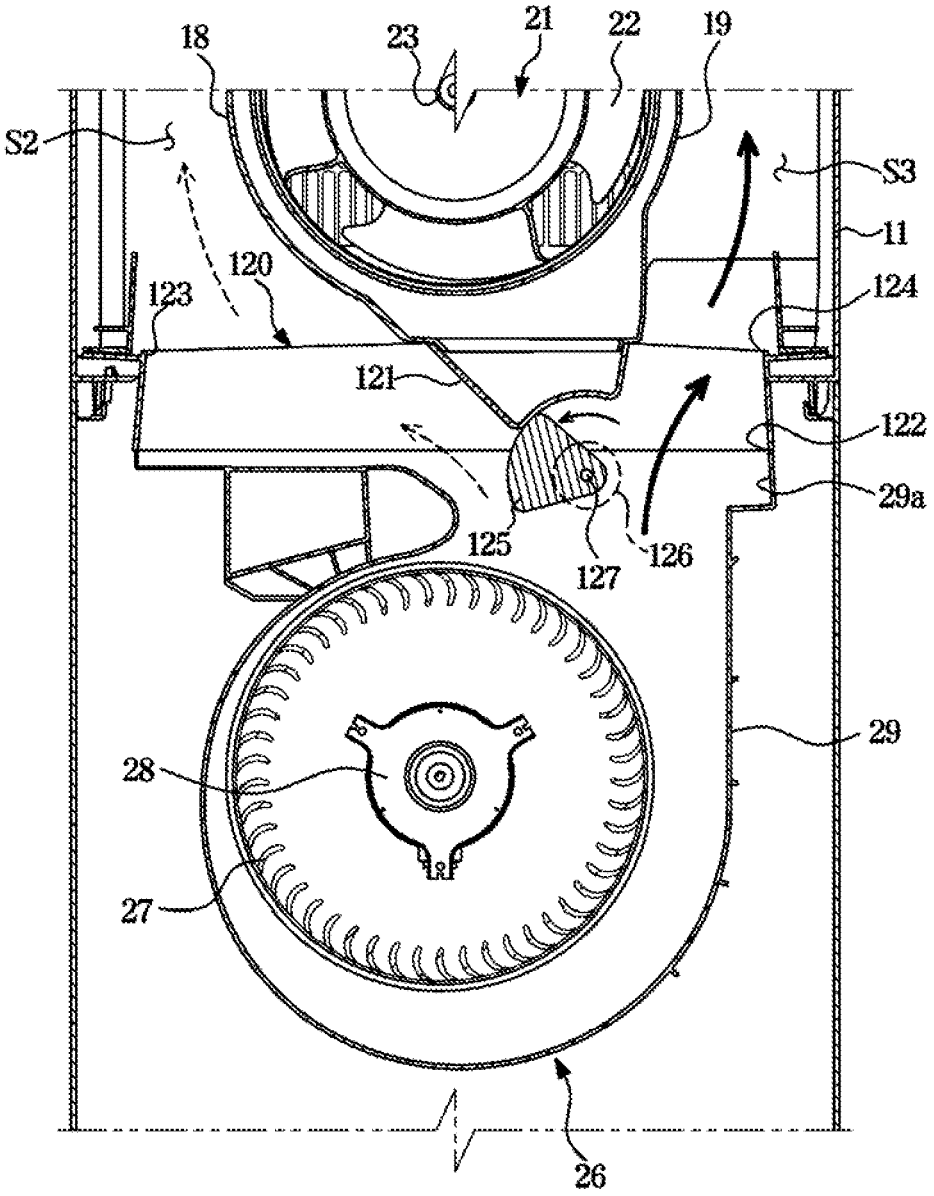
FIG. 13 is part of a cross-sectional view along line B-B' marked in FIG. 1, when the air conditioner shown in FIG. 12 is operated in the third mode to provide a left air current.
Figure 14:
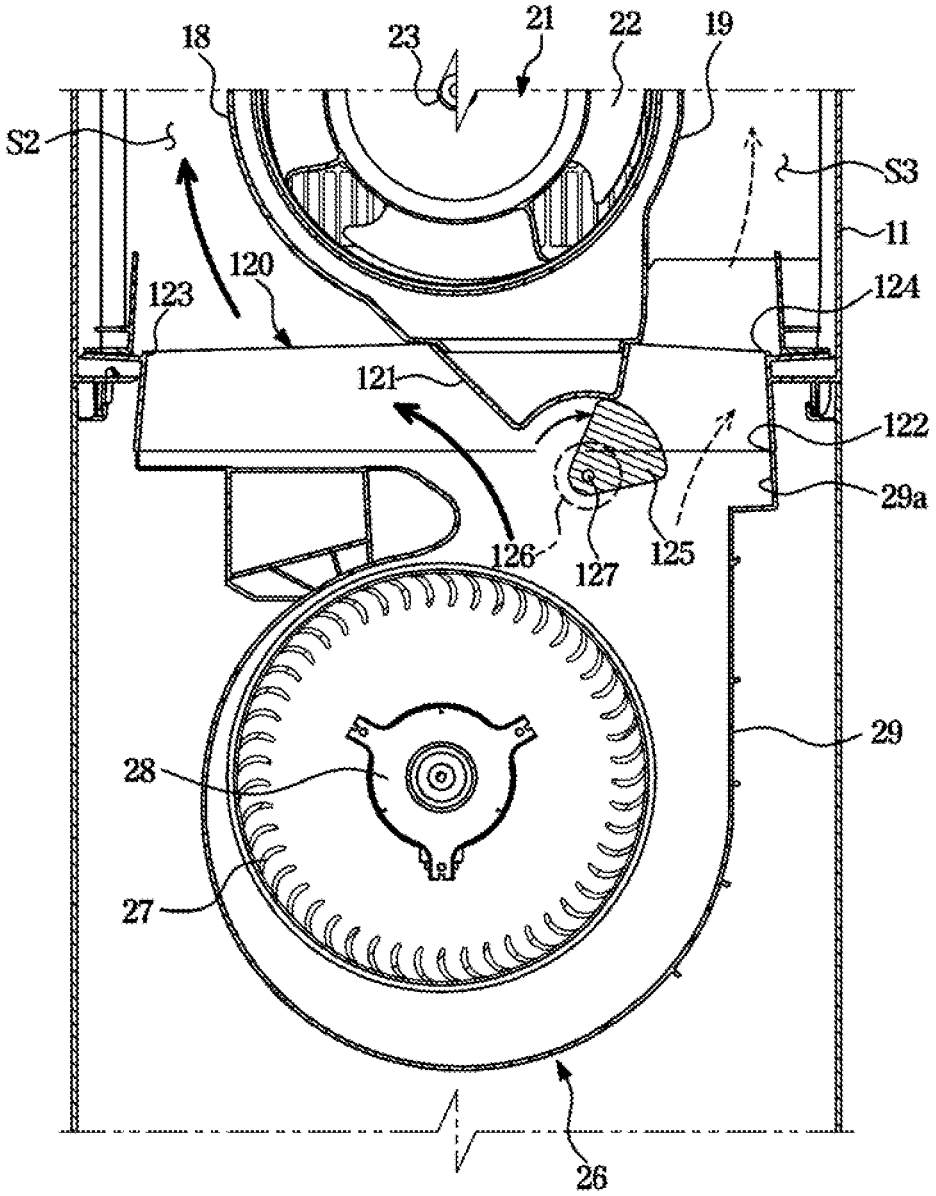
FIG. 14 is part of a cross-sectional view along line B-B' marked in FIG. 1, when the air conditioner shown in FIG. 12 is operated in the third mode to provide a right air current.

FIG. 12 is part of a cross-sectional view along line B-B' marked in FIG. 1, when an air conditioner including a distribution device is operated in the third mode to provide a central air current, according to another embodiment of the disclosure. FIG. 13 is part of a cross-sectional view along line B-B' marked in FIG. 12, when the air conditioner shown in FIG. 1 is operated in the third mode to provide a left air current. FIG. 14 is part of a cross-sectional view along line B-B' marked in FIG. 1, when the air conditioner shown in FIG. 12 is operated in the third mode to provide a right air current.

Referring to FIGS. 12 to 14, a distribution device 120 according to another embodiment of the disclosure will be described. The same parts as those in FIGS. 1 to 11 will have the same reference numerals, and the detailed description thereof will not be repeated.

Referring to FIG. 12, the distribution device 120 according to the embodiment of the disclosure may include a distribution case 121 mounted in the body case 11. The distribution case 121 may include a distribution inlet 122 connected to the second blower device 26, a first distribution outlet 123 connected to the first duct 18, and a second distribution outlet 124 connected to the second duct 19. The distribution case 121 may be formed to distribute the air brought in through the distribution inlet 122 into the first distribution outlet 123 and the second distribution outlet 124.

The distribution device 120 may include a damper 125 for controlling a volume of air discharged into the first duct 18 and the second duct 19, and a damper driving source 126.

The damper 125 may be arranged to be turned in a path in which the air brought in through the distribution inlet 122 is moved to the first distribution outlet 123 and the second distribution outlet 124. The damper 125 may be arranged to be turned around a damper shaft 127.

The damper 125 may be in a first position to block at least a portion of the second fluid path S2 formed between the second inlet 15 and the first guide discharge port 13, as shown in FIG. 13. In other words, the damper 125 may be in the first position to block at least a portion of a fluid path connecting the distribution inlet 122 to the first distribution outlet 123.

The damper 125 may be in a second position to block at least a portion of the third fluid path S3 formed between the second inlet 15 and the second guide discharge port 14, as shown in FIG. 14. In other words, the damper 125 may be in the second position to block at least a portion of a fluid path connecting the distribution inlet 122 to the second distribution outlet 124.

The damper driving source 126 may generate power to move the damper 125. The damper driving source 126 may include a motor 116.

With this structure, when the air conditioner 1 is going to discharge heat-exchanged air along the center as shown in FIG. 5, the damper 125 may be placed between the first position and the second position. Hence, the air blown from the second blower device 26 may be almost uniformly distributed into the first duct 18 and the second duct 19, so that an amount of air discharged through the first guide discharge port 13 may be almost the same as an amount of air discharged through the second guide discharge port 14.

On the other hand, when the air conditioner 1 is going to discharge the heat-exchanged air to the left side on which the first guide discharge port 13 is arranged as shown in FIG. 9, the damper 125 may be turned to the first position to block at least a portion of the air directed to the first distribution outlet 123 as shown in FIG. 13. That is, the damper 125 may be turned counterclockwise. Hence, more of the air blown from the second blower device 26 may be moved to the second duct 19 than to the first duct 18, so that an amount of air discharged through the second guide discharge port 14 may be greater than an amount of air discharged through the first guide discharge port 13. Accordingly, pressure on the side of the first guide discharge port 13 is reduced, and the air discharged from the second guide discharge port 14 may be moved toward the left along with the air discharged from the main discharge port 17.

On the other hand, when the air conditioner 1 is going to discharge the heat-exchanged air to the right side on which the second guide discharge port 14 is arranged as shown in FIG. 10, the damper 125 may be turned to the second position to block at least a portion of the air moved to the second distribution outlet 124 as shown in FIG. 14. That is, the damper 125 may be turned clockwise. Hence, more of the air blown from the second blower device 26 may be moved to the first duct 18 than to the second duct 19, so that an amount of air discharged through the first guide discharge port 13 may be greater than an amount of air discharged through the second guide discharge port 14. Accordingly, pressure on the side of the second guide discharge port 14 is reduced, and the air discharged from the first guide discharge port 13 may be moved toward the right along with the air discharged from the main discharge port 17.

With this structure, the air conditioner 1 having the distribution device 120 according to the embodiment of the disclosure may control wind direction of the heat-exchanged air without an extra structural part in the guide discharge ports 13 and 14.

Figure 15:
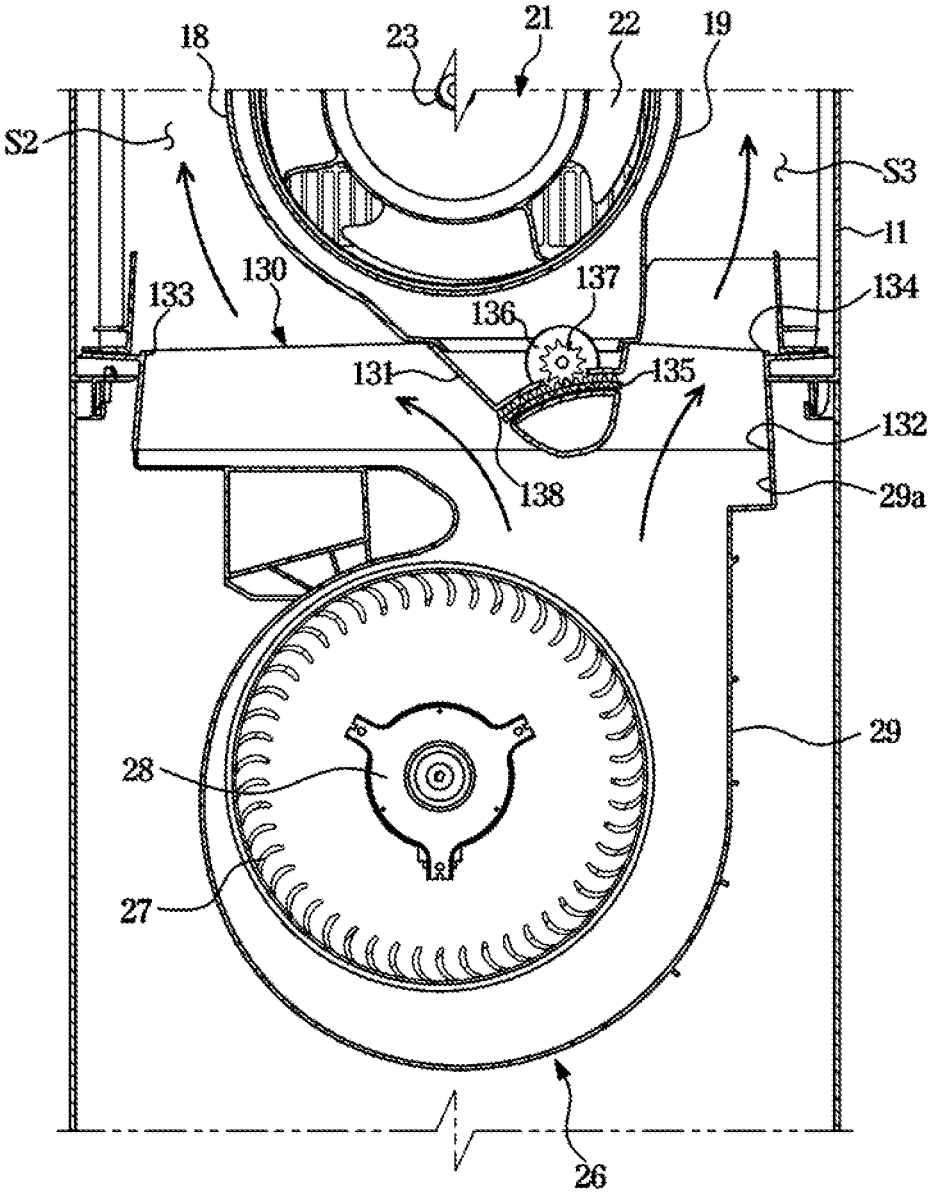
FIG. 15 is part of a cross-sectional view along line B-B' marked in FIG. 1, when an air conditioner including a distribution device is operated in the third mode to provide a central air current, according to another embodiment of the disclosure.
Figure 16:
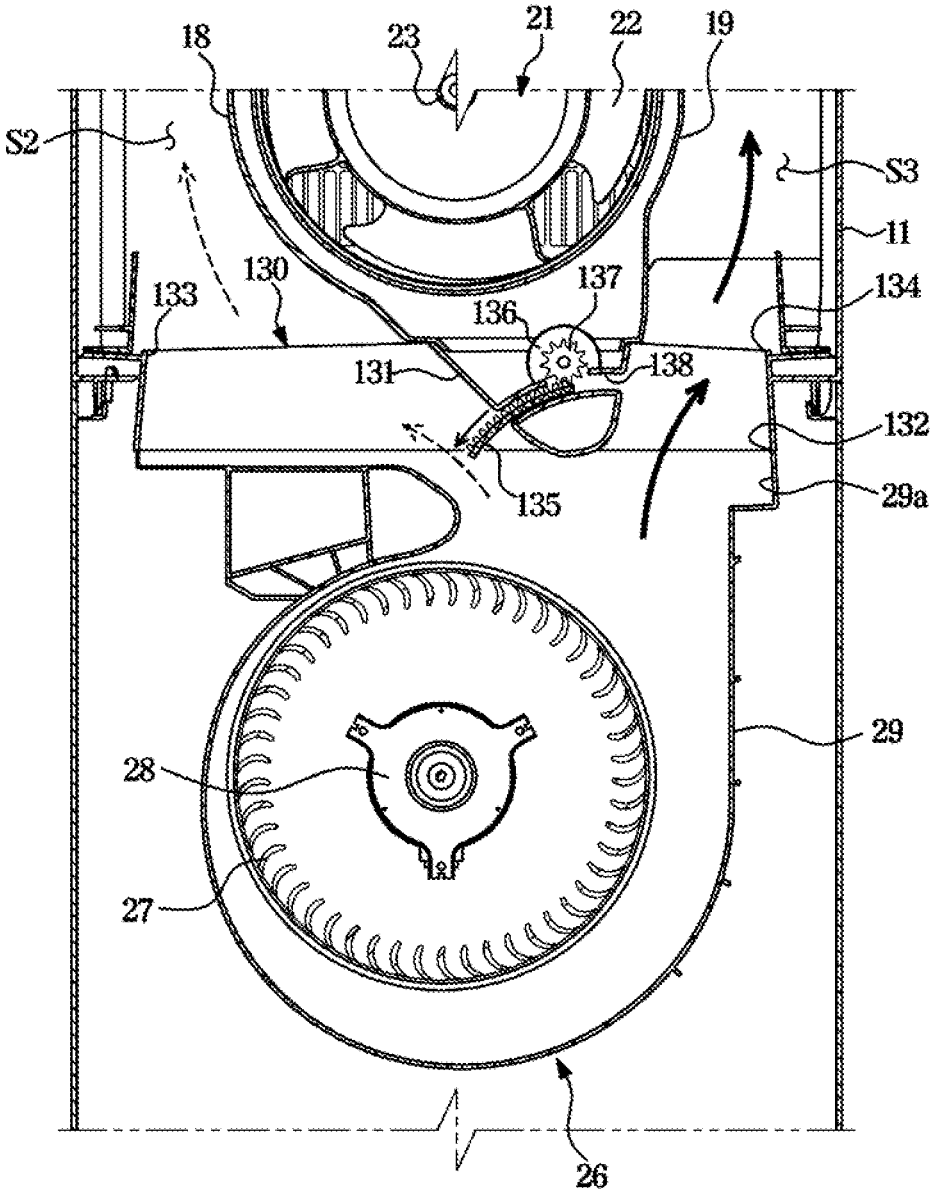
FIG. 16 is part of a cross-sectional view along line B-B' marked in FIG. 1, when the air conditioner shown in FIG. 15 is operated in the third mode to provide a left air current.
Figure 17:
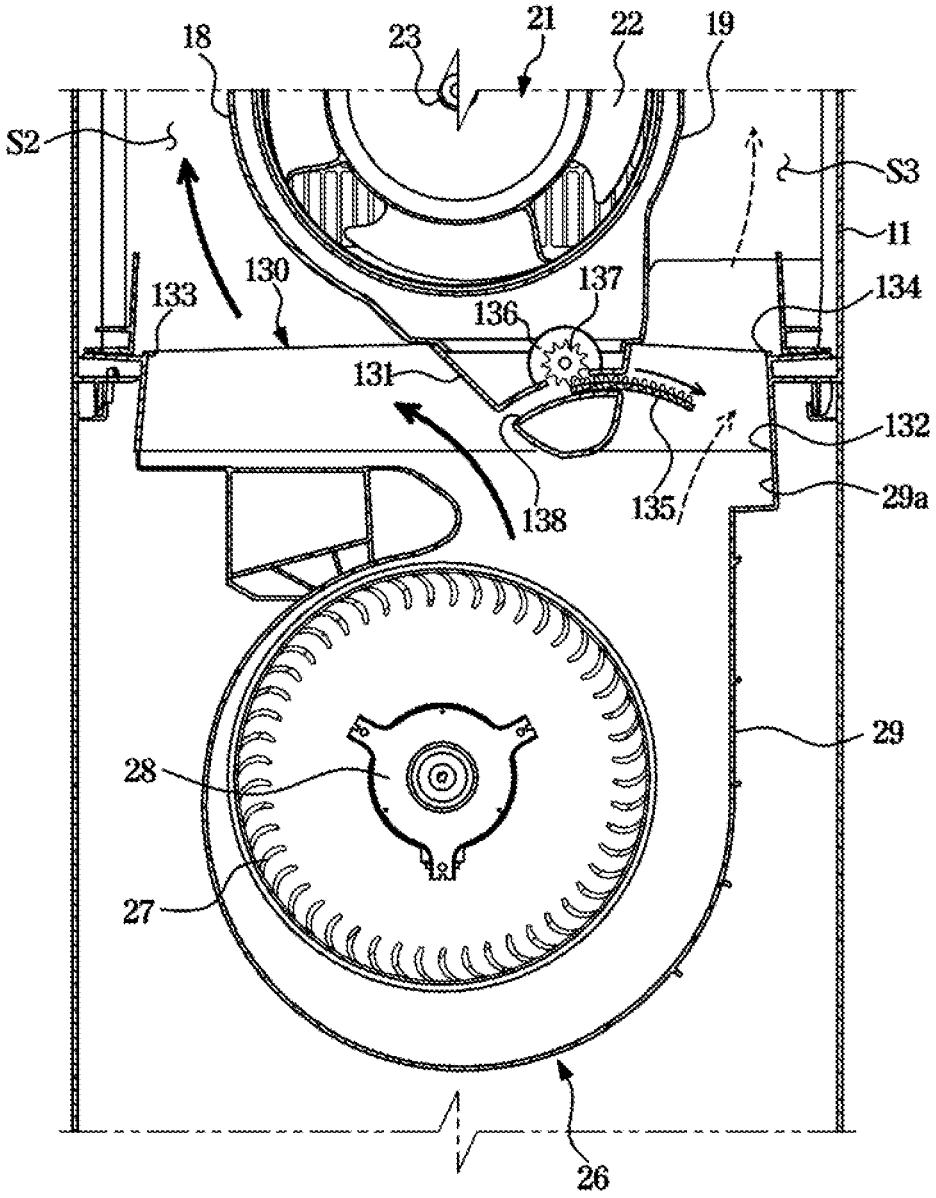
FIG. 17 is part of a cross-sectional view along line B-B' marked in FIG. 1, when the air conditioner shown in FIG. 15 is operated in the third mode to provide a right air current.

FIG. 15 is part of a cross-sectional view along line B-B' marked in FIG. 1, when an air conditioner including a distribution device according to another embodiment of the disclosure is operated in the third mode to provide a central air current. FIG. 16 is part of a cross-sectional view along line B-B' marked in FIG. 15, when the air conditioner shown in FIG. 1 is operated in the third mode to provide a left air current. FIG. 17 is part of a cross-sectional view along line B-B' marked in FIG. 15, when the air conditioner shown in FIG. 1 is operated in the third mode to provide a right air current.

Referring to FIGS. 15 to 17, a distribution device 130 according to another embodiment of the disclosure will be described. The same parts as those in FIGS. 1 to 11 will have the same reference numerals, and the detailed description thereof will not be repeated.

Referring to FIG. 15, a distribution device 130 according to the embodiment of the disclosure may include a distribution case 131 mounted in the body case 11. The distribution case 131 may include a distribution inlet 132 connected to the second blower device 26, a first distribution outlet 133 connected to the first duct 18, and a second distribution outlet 134 connected to the second duct 19. The distribution case 131 may be formed to distribute the air brought in through the distribution inlet 132 into the first distribution outlet 133 and the second distribution outlet 134.

The distribution device 130 may include a damper 135 for controlling a volume of air discharged to the first duct 18 and the second duct 19, a damper driving source 136, and a power transfer member 137.

The damper 135 may be arranged to be movable in a path in which the air brought in through the distribution inlet 132 is moved to the first distribution outlet 133 and the second distribution outlet 134. The damper 135 may slide into a damper guide 138 formed in the distribution case 131. Accordingly, when the air conditioner 1 provides heat-exchanged air along the center, the damper 135 is inserted to the damper guide 138 and does not interfere the air distributed into the first duct 18 and the second duct 19. In other words, the damper 135 completely gets out of the second fluid path S2 and the third fluid path S3.

The damper 135 may be in a first position to block at least a portion of the second fluid path S2 formed between the second inlet 15 and the first guide discharge port 13, as shown in FIG. 16. In other words, the damper 135 may be in the first position to block at least a portion of a fluid path connecting the distribution inlet 132 to the first distribution outlet 133.

The damper 135 may be in a second position to block at least a portion of the third fluid path S3 formed between the second inlet 15 and the second guide discharge port 17, as shown in FIG. 14. In other words, the damper 135 may be in the second position to block at least a portion of a fluid path connecting the distribution inlet 132 to the second distribution outlet 134.

The damper driving source 136 may generate power to move the damper 135. The damper driving source 136 may include a motor 116.

The power transfer member 137 may transfer power generated by the damper driving source 136 to the damper 135. Although the power transfer member 137 is shown in FIG. 15 as including a rack gear formed at the damper 135 and a pinion gear coupled to the damper driving source 136, it is not limited thereto as long as it has a structure that allows the power of the damper driving source 136 to be transferred to the damper 135.

With this structure, when the air conditioner 1 is going to discharge heat-exchanged air along the center as shown in FIG. 5, the damper 135 may be placed between the first position and the second position. Hence, the air blown from the second blower device 26 may be almost uniformly distributed into the first duct 18 and the second duct 19, so that an amount of air discharged through the first guide discharge port 13 may be almost the same as an amount of air discharged through the second guide discharge port 14.

On the other hand, when the air conditioner 1 is going to discharge the heat-exchanged air to the left side on which the first guide discharge port 13 is arranged as shown in FIG. 9, the damper 135 may be drawn out from the damper guide 138 and moved to the first position to block at least a portion of the air moved to the first distribution outlet 133 as shown in FIG. 16. Hence, more of the air blown from the second blower device 26 may be moved to the second duct 19 than to the first duct 18, so that an amount of air discharged through the second guide discharge port 14 may be greater than an amount of air discharged through the first guide discharge port 13. Accordingly, pressure on the side of the first guide discharge port 13 is reduced, and the air discharged from the second guide discharge port 14 may be moved toward the left along with the air discharged from the main discharge port 17.

On the other hand, when the air conditioner 1 is going to discharge the heat-exchanged air to the right side on which the second guide discharge port 14 is arranged as shown in FIG. 10, the damper 135 may be turned to the second position to block at least a portion of the air moved to the second distribution outlet 134 as shown in FIG. 17. That is, the damper 135 may be turned clockwise. Hence, more of the air blown from the second blower device 26 may be moved to the first duct 18 than to the second duct 19, so that an amount of air discharged through the first guide discharge port 13 may be greater than an amount of air discharged through the second guide discharge port 14. Accordingly, pressure on the side of the second guide discharge port 14 is reduced, and the air discharged from the first guide discharge port 13 may be moved toward the right along with the air discharged from the main discharge port 17.

With this structure, the air conditioner 1 having the distribution device 130 according to the embodiment of the disclosure may control wind direction of the heat-exchanged air without an extra structural part in the guide discharge ports 13 and 14.

Figure 18:
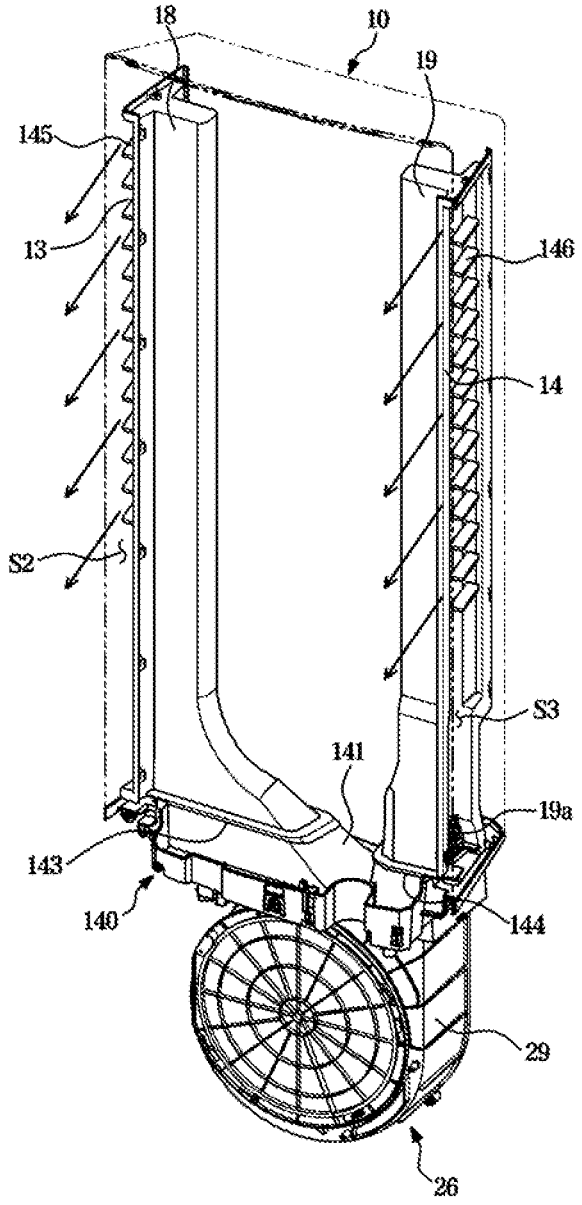
FIG. 18 illustrates an air conditioner including a distribution device operated in the third mode to provide a central air current, according to another embodiment of the disclosure.
Figure 19:
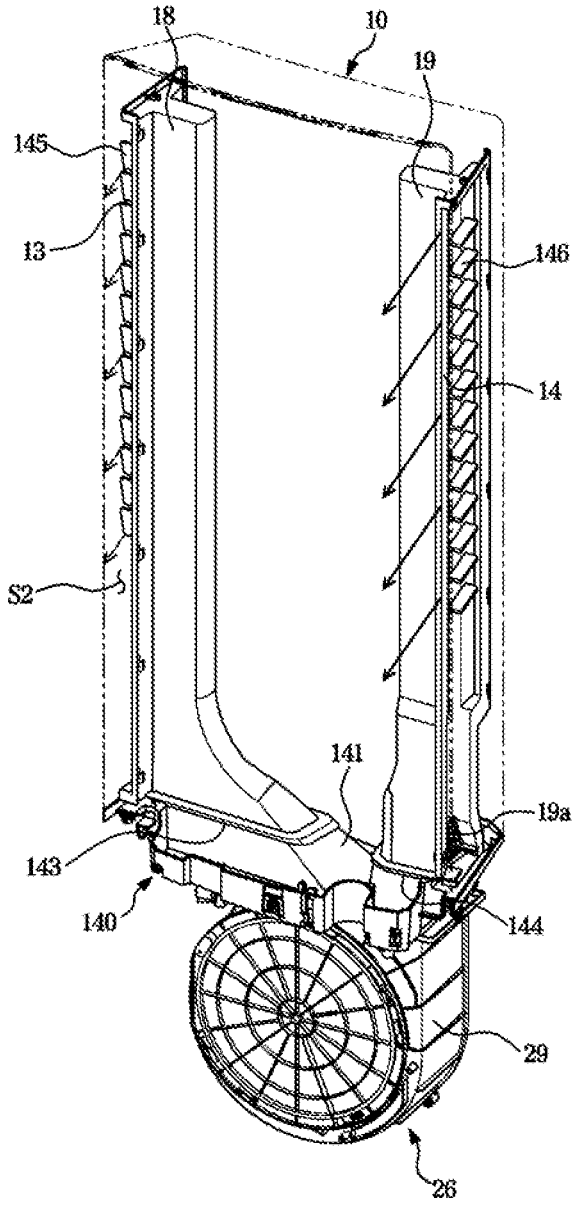
FIG. 19 illustrates the air conditioner shown in FIG. 18 operated in the third mode to provide a left air current.
Figure 20:
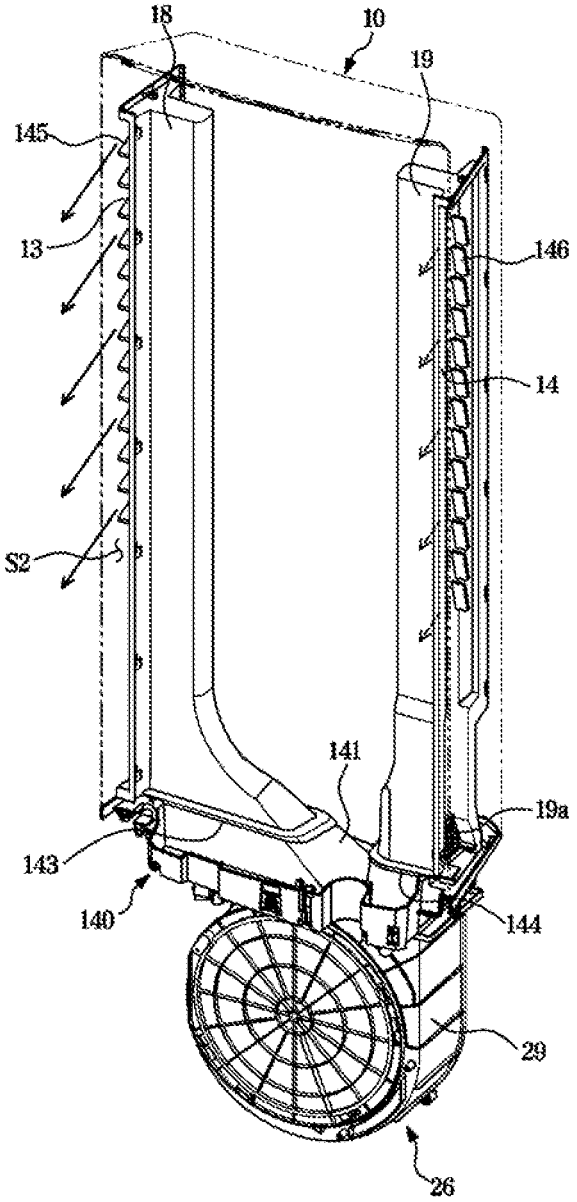
FIG. 20 illustrates the air conditioner shown in FIG. 18 operated in the third mode to provide a right air current.
Figure 21:
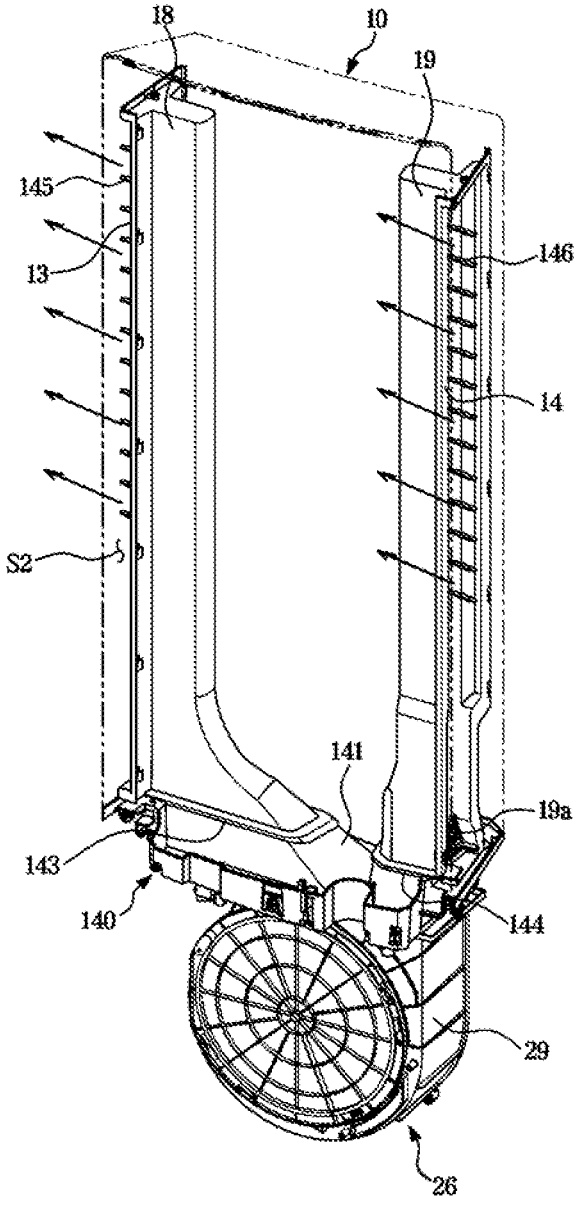
FIG. 21 illustrates wind direction of the air conditioner shown in FIG. 18 controlled upward.
Figure 22:
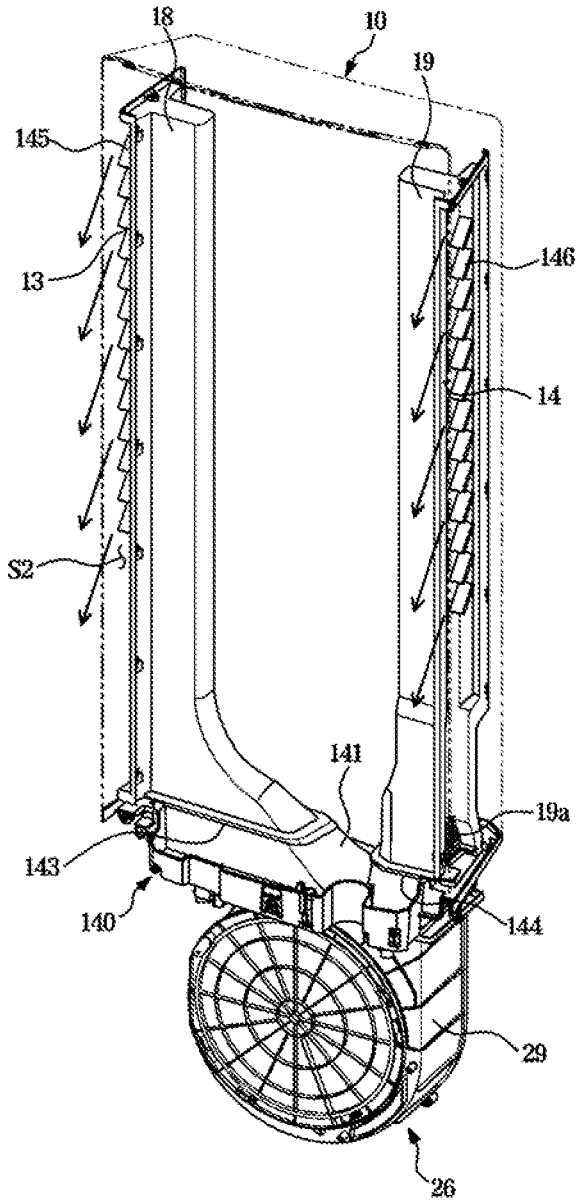
FIG. 22 illustrates wind direction of the air conditioner shown in FIG. 18 controlled downward.

FIG. 18 illustrates an air conditioner including a distribution device operated in the third mode to provide a central air current, according to another embodiment of the disclosure. FIG. 19 illustrates the air conditioner shown in FIG. 18 operated in the third mode to provide a left air current. FIG. 20 illustrates the air conditioner shown in FIG. 18 operated in the third mode to provide a right air current. FIG. 21 illustrates wind direction of the air conditioner shown in FIG. 18 controlled upward. FIG. 22 illustrates wind direction of the air conditioner shown in FIG. 18 controlled downward.

Referring to FIGS. 18 to 22, a distribution device 140 according to another embodiment of the disclosure will be described. The same parts as those in FIGS. 1 to 11 will have the same reference numerals, and the detailed description thereof will not be repeated.

Referring to FIG. 18, the distribution device 140 according to the embodiment of the disclosure may include a distribution case 141 mounted in the body case 11. The distribution case 141 may include a distribution inlet (not shown) connected to the second blower device 26, a first distribution outlet 143 connected to the first duct 18, and a second distribution outlet 144 connected to the second duct 19. The distribution case 141 may be formed to distribute the air brought in through the distribution inlet to the first distribution outlet 143 and the second distribution outlet 144.

The distribution device 140 may include a first damper 145 arranged in the first duct 18 and a second damper 146 arranged in the second duct 19. The first damper 145 may be rotationally arranged in the first duct 18, and the second damper 146 may be rotationally arranged in the second duct 19. The first damper 145 and the second damper 146 may be arranged to be rotated against the housing 10. The first damper 145 may be arranged to be turned around a rotation axis in a direction of width of the first guide discharge port 13. The second damper 146 may be arranged to be turned around a rotation axis in a direction of width of the second guide discharge port 14. The first damper 145 may be arranged to block at least a portion of the first guide discharge port 13. The second damper 146 may be arranged to block at least a portion of the second guide discharge port 14. The first damper 145 and the second damper 146 may be separately operated. The first damper 145 may be arranged in the plural in a direction in which the first guide discharge port 13 extends. The second damper 146 may be arranged in the plural in a direction in which the second guide discharge port 14 extends.

When the air conditioner 1 is operated in the third mode to form a central air current as shown in FIG. 5, the first damper 145 may open the first guide discharge port 13 and the second damper 146 may open the second guide discharge port 14. Accordingly, the amount of air discharged through the first guide discharge port 13 may be almost the same as the amount of air discharged through the second guide discharge port 14, so the air conditioner 1 may discharge the heat-exchanged air discharged from the main discharge port 17 along the center.

On the other hand, referring to FIG. 19, when the air conditioner 1 is operated in the third mode to form a left air current as shown in FIG. 9, the first damper 145 may be turned to a direction to close the first guide discharge port 13. In other words, the first damper 145 may be turned to a direction to reduce an air discharge area of the first guide discharge port 13. Accordingly, the amount of air discharged from the second guide discharge port 14 is greater than the amount of air discharged from the first guide discharge port 13. Accordingly, pressure on the side of the first guide discharge port 13 is reduced, and the air discharged from the second guide discharge port 14 may be moved toward the left along with the air discharged from the main discharge port 17.

On the other hand, referring to FIG. 20, when the air conditioner 1 is operated in the third mode to form a right air current as shown in FIG. 10, the second damper 146 may be turned to a direction to close the second guide discharge port 14. In other words, the second damper 146 may be turned to a direction to reduce an air discharge area of the second guide discharge port 14. Accordingly, the amount of air discharged from the first guide discharge port 13 is greater than the amount of air discharged from the second guide discharge port 14. Accordingly, pressure on the side of the second guide discharge port 14 is reduced, and the air discharged from the first guide discharge port 13 may be moved toward the right along with the air discharged from the main discharge port 17.

Furthermore, referring to FIGS. 21 and 22, the air conditioner 1 may control the wind direction of air discharged from the main discharge port 17 into the vertical direction as the first damper 145 and the second damper 146 are turned.

Specifically, referring to FIG. 21, when the first damper 145 is turned to guide the air discharged from the first guide discharge port 13 upward and the second damper 146 is turned to guide the air discharged from the second guide discharge port 14 upward, the heat-exchanged air discharged from the main discharge port 17 may be moved upward along with the air discharged from the first guide discharge port 13 and the second guide discharge port 14.

On the other hand, referring to FIG. 22, when the first damper 145 is turned to guide the air discharged from the first guide discharge port 13 downward and the second damper 146 is turned to guide the air discharged from the second guide discharge port 14 downward, the heat-exchanged air discharged from the main discharge port 17 may be moved downward along with the air discharged from the first guide discharge port 13 and the second guide discharge port 14.

With this structure, when the air conditioner 1 is operated in the third mode, it may move cold air discharged through the main discharge port 17 upward or downward. Furthermore, the air conditioner 1 may keep changing the wind direction of cold air by continuously turning the first damper 145 and the second damper 146.

Several embodiments of the disclosure have been described above, but a person of ordinary skill in the art will understand and appreciate that various modifications can be made without departing from the scope of the disclosure. Thus, it will be apparent to those or ordinary skill in the art that the true scope of technical protection is only defined by the following claims.

The invention claimed is:

1. An air conditioner comprising:

a housing having a first inlet and a second inlet;

a main discharge port formed on a front surface of the housing to discharge air brought in from the first inlet;

a first guide discharge port formed on the front surface of the housing to discharge a first portion of air brought in through the second inlet to be mixed with air discharged from the main discharge port;

a second guide discharge port formed on the front surface of the housing to discharge a second portion of the air brought in through the second inlet to be mixed with the air discharged from the main discharge port;

a heat exchanger arranged in a first fluid path formed between the first inlet and the main discharge port;

a first blower device arranged to suck in air through the first inlet and discharge, through the main discharge port, the air sucked in through the first inlet;

a second blower device arranged to suck in air through the second inlet and discharge, through the first guide discharge port and the second guide discharge port, the air sucked in through the second inlet; and a distribution device arranged to control a first rate of flow of air discharged through the first guide discharge port and a second rate of flow of air discharged through the second guide discharge port.

2. The air conditioner of claim 1, wherein the distribution device is arranged in a portion of the housing from which the first portion of air brought in from the second inlet is branched toward the first guide discharge port and the second portion of air brought in from the second inlet is branched toward the second guide discharge port.

3. The air conditioner of claim 1, further comprising:

a discharge panel arranged in a portion of the housing in which the main discharge port is formed, and having a plurality of discharge holes through which to discharge the air discharged from the main discharge port at a slower rate than air discharged from the first guide discharge port and air discharged from the second guide discharge port.

4. The air conditioner of claim 1, wherein the first guide discharge port is arranged on a first side of the main discharge port, and the second guide discharge port is arranged on a second side of the main discharge port.

5. The air conditioner of claim 1, wherein the distribution device is arranged to be adjacent to a fan discharge port of the second blower device.

6. The air conditioner of claim 1, wherein the distribution device comprises:

a damper driving source; and a damper moving or turning with power from the damper driving source and arranged to move or turn between a first position at which to block at least a portion of a second fluid path formed between the second inlet and the first guide discharge port and a second position at which to block at least a portion of a third fluid path formed between the second inlet and the second guide discharge port.

7. The air conditioner of claim 1, wherein the distribution device comprises:

a plurality of first dampers arranged to block at least a portion of the first guide discharge port and placed in a direction in which the first guide discharge port extends; and a plurality of second dampers arranged to block at least a portion of the second guide discharge port and placed in a direction in which the second guide discharge port extends.

8. The air conditioner of claim 7, wherein the plurality of first dampers and the plurality of second dampers are arranged to turn against the housing.

9. The air conditioner of claim 1, wherein the first guide discharge port and the second guide discharge port are formed on a same plane as a plane of the housing on which the main discharge port is formed.

10. The air conditioner of claim 1, wherein the housing comprises:

a first duct guiding the first portion of air blown by the second blower device to the first guide discharge port and forming a second fluid path separated from the first fluid path; and a second duct guiding the second portion of air blown by the second blower device to the second guide discharge port and forming a third fluid path separated from the first fluid path.

11. The air conditioner of claim 1, further comprising:

a controller configured to control the distribution device, the controller configured to:

control the distribution device to reduce the first rate of flow of air discharged through the first guide discharge port when a direction of air discharged from the main discharge port is set to a first side of the front surface on which the first guide discharge port is formed, and control the distribution device to reduce the second rate of flow of air discharged through the second guide discharge port when the direction of air discharged from the main discharge port is set to a second side of the front surface on which the second guide discharge port is formed.

12. The air conditioner of claim 1, wherein the first blower device comprises an axial fan, and the second blower device comprises a centrifugal fan.

13. The air conditioner of claim 1, wherein the second blower device is arranged to be driven separately from the first blower device.

14. The air conditioner of claim 3, wherein the heat exchanger is arranged in the first fluid path between the first inlet and the first blower device.

15. The air conditioner of claim 1, wherein the main discharge port is arranged to discharge air having exchanged heat with the heat exchanger, and the first guide discharge port and the second guide discharge port are arranged to discharge air having not exchanged heat with the heat exchanger.

* * * * *